US011629587B2

(12) United States Patent
Skinner et al.

(10) Patent No.: US 11,629,587 B2
(45) Date of Patent: Apr. 18, 2023

(54) SYSTEMS AND METHODS FOR DIELECTRIC MAPPING DURING PULSED-POWER DRILLING

(71) Applicant: Halliburton Energy Services, Inc., Houston, TX (US)

(72) Inventors: Neal Gregory Skinner, Lewisville, TX (US); Burkay Donderici, Pittsford, NY (US); Charles Richard Thomas Hay, Spring, TX (US); Ilker R. Capoglu, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 14 days.

(21) Appl. No.: 17/057,453

(22) PCT Filed: Jun. 20, 2018

(86) PCT No.: PCT/US2018/038421
§ 371 (c)(1),
(2) Date: Nov. 20, 2020

(87) PCT Pub. No.: WO2019/245544
PCT Pub. Date: Dec. 26, 2019

(65) Prior Publication Data

US 2021/0164332 A1 Jun. 3, 2021

(51) Int. Cl.
*E21B 44/00* (2006.01)
*E21B 47/13* (2012.01)
(Continued)

(52) U.S. Cl.
CPC ..... *E21B 44/00* (2013.01); *E21B 7/15* (2013.01); *E21B 47/024* (2013.01); *E21B 47/0228* (2020.05); *E21B 47/13* (2020.05)

(58) Field of Classification Search
CPC .... E21B 44/00; E21B 47/0228; E21B 47/024; E21B 47/12; E21B 47/13; E21B 7/15; E21B 7/00
See application file for complete search history.

(56) References Cited

U.S. PATENT DOCUMENTS 4,741,405 A 5/1988 Moeny et al.
6,480,118 B1 11/2002 Rao
(Continued)

FOREIGN PATENT DOCUMENTS

WO 2008/003092 1/2008
WO 2010/027866 3/2010
(Continued)

OTHER PUBLICATIONS

"How to Measure Dielectric Constant" http://ghebook.blogspot.com/2011/10/how-to-measure-dielectric-constant.html. pp. 2-3 and figure 4, 12 pages. (Year: 2011).*
(Continued)

*Primary Examiner* — Caroline N Butcher
(74) *Attorney, Agent, or Firm* — Delizio, Peacock, Lewin & Guerra

(57) ABSTRACT

In some embodiments, a downhole drilling system may include a pulse-generating circuit, a drill bit including a first pair of electrodes electrically coupled to the pulse-generating circuit to receive a first electrical pulse from the pulse-generating circuit and form a first electrical arc between the first pair of electrodes during a pulsed drilling operation. The system further includes a sensor to record responses to the first electrical pulse during the pulsed drilling operation and a sensor analysis system communicatively coupled to the sensor, where the sensor analysis system is configured to obtain a first measurement from the sensor representing the responses recorded by the sensor during the pulsed drilling operation. Additionally, the system may determine a first
(Continued)

value of a dielectric constant associated with a portion of a formation in proximity to the drill bit, where the first value of the dielectric constant is based on the first measurement.

22 Claims, 12 Drawing Sheets

(51) Int. Cl.

| | |
|---|---|
| ***E21B 47/0228*** | (2012.01) |
| ***E21B 47/024*** | (2006.01) |
| ***E21B 7/15*** | (2006.01) |

(56) References Cited

U.S. PATENT DOCUMENTS

| | | | | |
|---|---|---|---|---|
| 8,479,841 | B2 | 7/2013 | Rosten et al. | |
| 9,181,754 | B2 | 11/2015 | Donderici et al. | |
| 2010/0212962 | A1* | 8/2010 | Rosten | E21B 7/15 175/40 |
| 2011/0308859 | A1* | 12/2011 | Bittar | E21B 47/022 175/45 |
| 2013/0032404 | A1 | 2/2013 | Donderici et al. | |
| 2015/0361789 | A1* | 12/2015 | Donderici | E21B 47/09 367/82 |
| 2016/0341587 | A1* | 11/2016 | Huang | E21B 47/00 |

FOREIGN PATENT DOCUMENTS

| | | |
|---|---|---|
| WO | 2019/245541 | 12/2019 |
| WO | 2019/245545 | 12/2019 |

OTHER PUBLICATIONS

International Search Report and Written Opinion received for PCT Patent Application No. PCT/US2018/38421, dated Mar. 19, 2019; 18 pages.

"How to Measure Dielectric Constant" https://ghebook.blogspot.com/2011/10/how-to-measure-dielectric-constant.html. pp. 2-3 and figure 4, 12 pages.

Strack, Kurt-Martin, et al., "Exploration with Deep Transient Electromagnetics," in: Methods in Geochemistry and Geophysics, (New York, Elsevier-Amsterdam, 1992), Table of Contents, Ch. 1 (pp. 1-20), Ch. 4 (pp. 73-126), Ch. 7 (pp. 193-226), 134 pages (submitted in 2 parts).

* cited by examiner

SYSTEMS AND METHODS FOR DIELECTRIC MAPPING DURING PULSED-POWER DRILLING

RELATED APPLICATIONS

This application is a U.S. National Stage Application of International Application No. PCT/US2018/038421 filed Jun. 20, 2018, which designates the United States.

TECHNICAL FIELD

The present disclosure relates generally to downhole pulsed-power drilling and, more particularly, systems and methods for dielectric mapping during pulsed-power drilling.

BACKGROUND

Electrocrushing drilling uses pulsed-power technology to drill a wellbore in a rock formation. Pulsed-power technology repeatedly applies a high electric potential across the electrodes of a pulsed-power drill bit, which ultimately causes the surrounding rock to fracture. The fractured rock is carried away from the bit by drilling fluid and the bit advances downhole. Electrocrushing drilling operations may also be referred to as pulsed drilling operations.

BRIEF DESCRIPTION OF THE DRAWINGS

For a more complete understanding of the present disclosure and its features and advantages, reference is now made to the following description, taken in conjunction with the accompanying drawings, in which.

DETAILED DESCRIPTION

Figure 1:
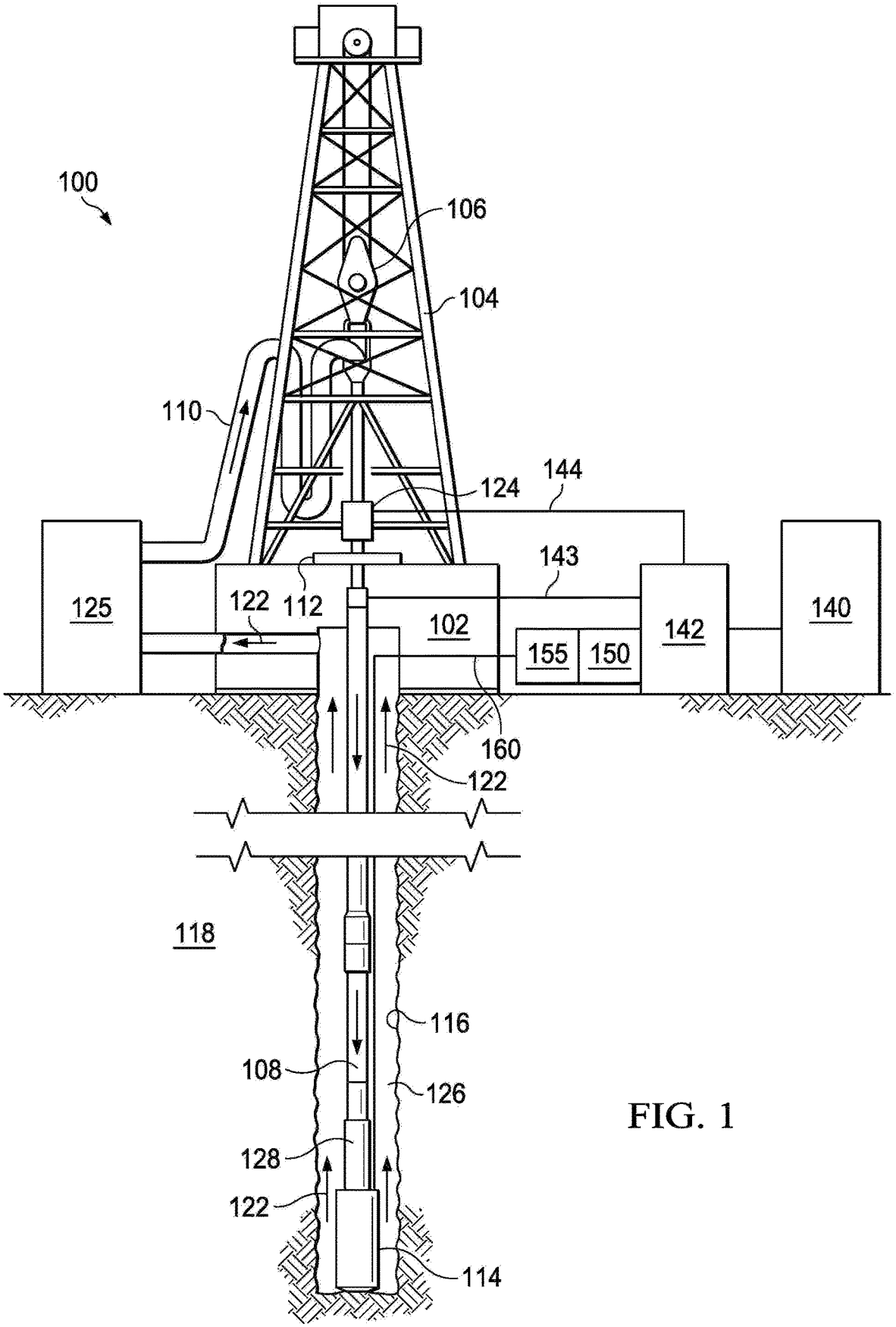
FIG. 1 is an elevation view of an exemplary pulsed-power drilling system used in a wellbore environment.

Electrocrushing drilling may be used to form wellbores in subterranean rock formations for recovering hydrocarbons, such as oil and gas, from these formations. Electrocrushing drilling uses pulsed-power technology to fracture the rock formation by repeatedly delivering electrical arcs or high-energy shock waves to the rock formation. More specifically, a drill bit of a pulsed-power drilling system is excited by a train of high-energy electrical pulses that produce discharges through the formation at the downhole end of the drill bit. The high-energy electrical pulses provide information about the properties of the formation and/or drilling fluid, such as the value of the dielectric constant. The discharges produced by the high-energy electrical pulses, in turn, fracture part of the formation proximate the drill bit and produce electromagnetic and acoustic waves that carry further information about properties of the formation. The azimuthal angles over which discharges take place between electrodes at the tip of the drill bit may occur randomly along those azimuthal angles for which the formation is still intact.

As described in detail herein, a pulsed-power drilling system with an associated sensor analysis system may implement logging-while-drilling techniques that include performing mapping of a formation using electrical and/or electromagnetic sensors located on the surface and/or downhole to record responses to received signals including, but not limited to high-energy electrical pulses, electrical arcs, and electromagnetic waves that are received during a pulsed drilling operation. The shape and magnitude of the high-energy electrical pulses, electrical arcs, or electromagnetic waves received by the sensors carry information that may be used to estimate characteristics of the formation layers through which the electrical arcs or waves have passed. For example, the dielectric value of the formation proximate to the pulsed-power drill bit may be estimated using the responses recorded by the sensors.

The sensors may convert the recorded responses into one or more measurements in a form suitable for analysis by a sensor analysis system. The resulting measurements may represent voltages, currents, ratios of voltage to current, measurements of magnetic field strength, or any combinations thereof that are associated with the flow of charge between two electrodes of the pulsed-power drill bit. The measurements may be provided by the sensors to a sensor analysis system, where they may be analyzed or stored for subsequent processing. For example, the sensor analysis system may process the measurements received from the sensors to determine the dielectric value of the formation proximate to the pulsed-power drill bit, the average direction of electrical arcs around the pulsed-power drill bit, and/or for other purposes based on the measurements received from the sensors. The dielectric value may be input into an inversion process to determine a resulting dielectric value, which may be used to map the dielectric value of the formation or to modify the pulsed drilling operation, such as by changing the drilling fluid.

There are numerous ways in which a dielectric mapping system may determine values of the dielectric constant for the formation proximate pulsed-power drill bit based on responses recorded during a pulsed drilling operation. Thus, embodiments of the present disclosure and its advantages are best understood by referring to FIGS. 1 through 12, where like numbers are used to indicate like and corresponding parts.

FIG. 1 is an elevation view of an exemplary pulsed-power drilling system used to form a wellbore in a subterranean formation. Although FIG. 1 shows land-based equipment, downhole tools incorporating teachings of the present disclosure may be satisfactorily used with equipment located on offshore platforms, drill ships, semi-submersibles, and drilling barges (not expressly shown). Additionally, while wellbore 116 is shown as being a generally vertical wellbore, wellbore 116 may be any orientation including generally horizontal, multilateral, or directional.

Drilling system 100 includes drilling platform 102 that supports derrick 104 having traveling block 106 for raising and lowering drill string 108. Drilling system 100 may also include pump 125, which circulates drilling fluid 122 through a feed pipe to kelly 110, which in turn conveys drilling fluid 122 downhole through interior channels of drill string 108 and through one or more fluid flow ports in pulsed-power drill bit 114. Drilling fluid 122 circulates back to the surface via annulus 126 formed between drill string 108 and the sidewalls of wellbore 116. Fractured portions of the formation are carried to the surface by drilling fluid 122 to remove those fractured portions from wellbore 116.

Pulsed-power drill bit 114 is attached to the distal end of drill string 108 and may be an electrocrushing drill bit or an electrohydraulic drill bit. Power may be supplied to drill bit 114 from components downhole, components at the surface and/or a combination of components downhole and at the surface. For example, generator 140 may generate electrical power and provide that power to power-conditioning unit 142. Power-conditioning unit 142 may then transmit electrical energy downhole via surface cable 143 and a subsurface cable (not expressly shown in FIG. 1) contained within drill string 108 or attached to the side of drill string 108. A pulse-generating circuit within BHA 128 may receive the electrical energy from power-conditioning unit 142, and may generate high-energy electrical pulses to drive drill bit 114. The pulse-generating circuit may include a power source input, including two input terminals, and a first capacitor coupled between the input terminals. The pulse-generating circuit may also include a switch, a transformer, and a second capacitor whose terminals are coupled to respective electrodes of drill bit 114. The switch may include a mechanical switch, a solid-state switch, a magnetic switch, a gas switch, or any other type of switch suitable to open and close the electrical path between the power source input and a first winding of the transformer. The transformer generates a current through a second winding when the switch is closed and current flows through first winding. The current through the second winding charges the second capacitor. As the voltage across the second capacitor increases, the voltage across the electrodes of the drill bit increases.

The pulse-generating circuit within BHA 128 may be utilized to repeatedly apply a large electric potential, for example up to or exceeding 150 kV, across the electrodes of drill bit 114. Each application of electric potential is referred to as a pulse. When the electric potential across the electrodes of drill bit 114 is increased enough during a pulse to generate a sufficiently high electric field, an electrical arc forms through rock formation 118 at the bottom of wellbore 116. The arc temporarily forms an electrical coupling between the electrodes of drill bit 114, allowing electric current to flow through the arc inside a portion of the rock formation at the bottom of wellbore 116. The arc greatly increases the temperature and pressure of the portion of the rock formation through which the arc flows and the surrounding formation and materials. The temperature and pressure is sufficiently high to break the rock itself into small bits or cuttings. This fractured rock is removed, typically by drilling fluid 122, which moves the fractured rock away from the electrodes and uphole. The terms "uphole" and "downhole" may be used to describe the location of various components of drilling system 100 relative to drill bit 114 or relative to the bottom of wellbore 116 shown in FIG. 1, rather than to describe relative directions in terms of true up or true down. Therefore, if wellbore 116 is a horizontal wellbore or is otherwise angled away from vertical, the term "uphole" may refer to the direction away from drill bit 114, regardless of whether that direction is to the right, to the left, up, or down relative to drill bit 114. For example, a first component described as uphole from a second component may be further away from drill bit 114 and/or the bottom of wellbore 116 than the second component. Similarly, a first component described as being downhole from a second component may be located closer to drill bit 114 and/or the bottom of wellbore 116 than the second component. The electrical arc may also generate acoustic and/or electromagnetic waves that are transmitted within rock formation 188 and/or drilling fluid 122. Sensors placed within wellbore 116 and/or on the surface may record responses to high-energy electrical pulses, electrical arcs, or electromagnetic waves. Sensor analysis system 150 may receive measurements representing the recorded responses and may analyze the measurements to determine characteristics of rock formation 118 or for other purposes.

Wellbore 116, which penetrates various subterranean rock formations 118, is created as drill bit 114 repeatedly fractures the rock formation and drilling fluid 122 moves the fractured rock uphole, wellbore 116. Wellbore 116 may be any hole formed into a subterranean formation or series of subterranean formations for the purpose of exploration or extraction of natural resources such as, for example, hydrocarbons, or for the purpose of injection of fluids such as, for example, water, wastewater, brine, or water mixed with other fluids. Additionally, wellbore 116 may be any hole drilled into a subterranean formation or series of subterranean formations for the purpose of geothermal power generation.

Although pulsed-power drill bit 114 is described above as implementing electrocrushing drilling, pulsed-power drill bit 114 may also be used for electrohydraulic drilling, rather than generating an electrical arc within the rock, drill bit 114 applies a large electrical potential across one or more electrodes and a ground ring to form an arc across the drilling fluid proximate to the downhole end of wellbore 116. The high temperature of the arc vaporizes the portion of the drilling fluid immediately surrounding the arc, which in turn generates a high-energy shock wave in the remaining fluid. The one or more electrodes of electrohydraulic drill bit may be oriented such that the shock wave generated by the arc is transmitted toward the bottom of wellbore 116. When the shock wave contacts and bounces off of the rock at the bottom of wellbore 116, the rock fractures. Accordingly, wellbore 116 may be formed in subterranean formation 118 using drill bit 114 that implements either electrocrushing or electrohydraulic drilling.

Distributed acoustic sensing (DAS) subsystem 155 may be positioned at the surface for use with pulsed-power drilling system 100, or at any other suitable location. DAS subsystem 155 may be coupled to optical fiber 160, which is positioned within a portion of the pulsed-power drilling system 100. For example, optical fiber 160 may be positioned within wellbore 116. Any suitable number of DAS subsystems (each coupled to an optical fiber 160 located downhole) may be placed inside or adjacent to wellbore 116. With optical fiber 160 positioned inside a portion of wellbore 116, DAS subsystem 155 may determine characteristics associated with formation 118 based on changes in strain caused by acoustic waves. DAS subsystem 155 may be configured to transmit optical pulses into optical fiber 160, and to receive and analyze reflections of the optical pulse to detect changes in strain caused by acoustic waves.

Figure 5:
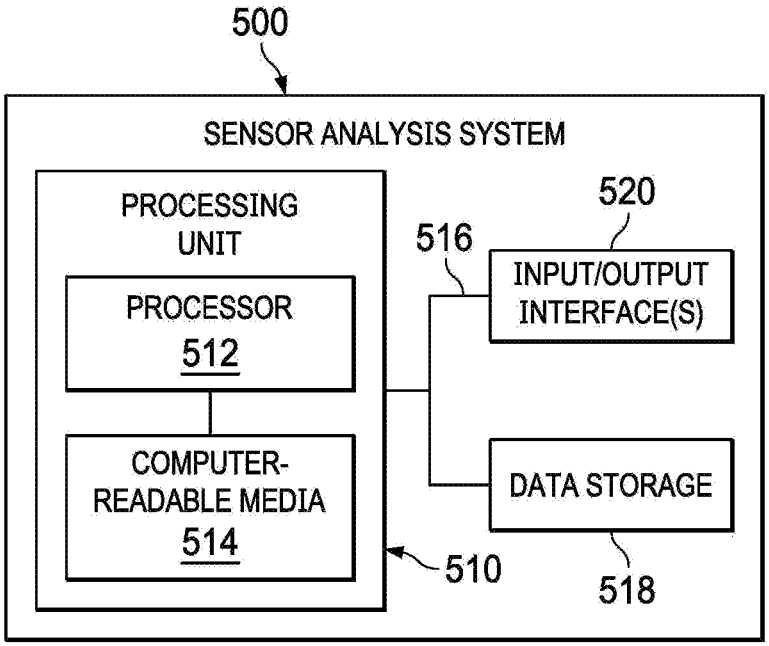
FIG. 5 is a block diagram illustrating an exemplary sensor analysis system associated with a pulsed-power drilling system.

Sensor analysis system 150 may be positioned at the surface for use with pulsed-power drilling system 100 as illustrated in FIG. 1, or at any other suitable location. Any suitable telemetry system may be used for communicating signals from various acoustic, electrical or electromagnetic sensors at the surface or downhole to sensor analysis system 150 during a pulsed drilling operation. For example, sensor analysis system 150 may be coupled to optical fiber 160 that extends downhole in wellbore 116. More specifically, one or more input/output interfaces of sensor analysis system 150 may be coupled to optical fiber 160 for communication to and from acoustic, electrical or electromagnetic sensors positioned downhole. For example, the sensors may transmit measurements to sensor analysis system 150. Any suitable number of sensor analysis systems 150 (each of which may be coupled to an optical fiber located downhole) may be placed inside or adjacent to wellbore 116. An exemplary sensor analysis system is illustrated in FIG. 5 and described in more detail below.

Optical fiber 160 may be enclosed within a cable, rope, line, or wire. More specifically, optical fiber 160 may be enclosed within a slickline, a wireline, coiled tubing, or another suitable conveyance for suspending a downhole tool in wellbore 116. Fiber optic cable 160 may be charged by a laser to provide power to DAS subsystem 155, sensor analysis system 150, or sensors located within wellbore 116.

Figure 2A:
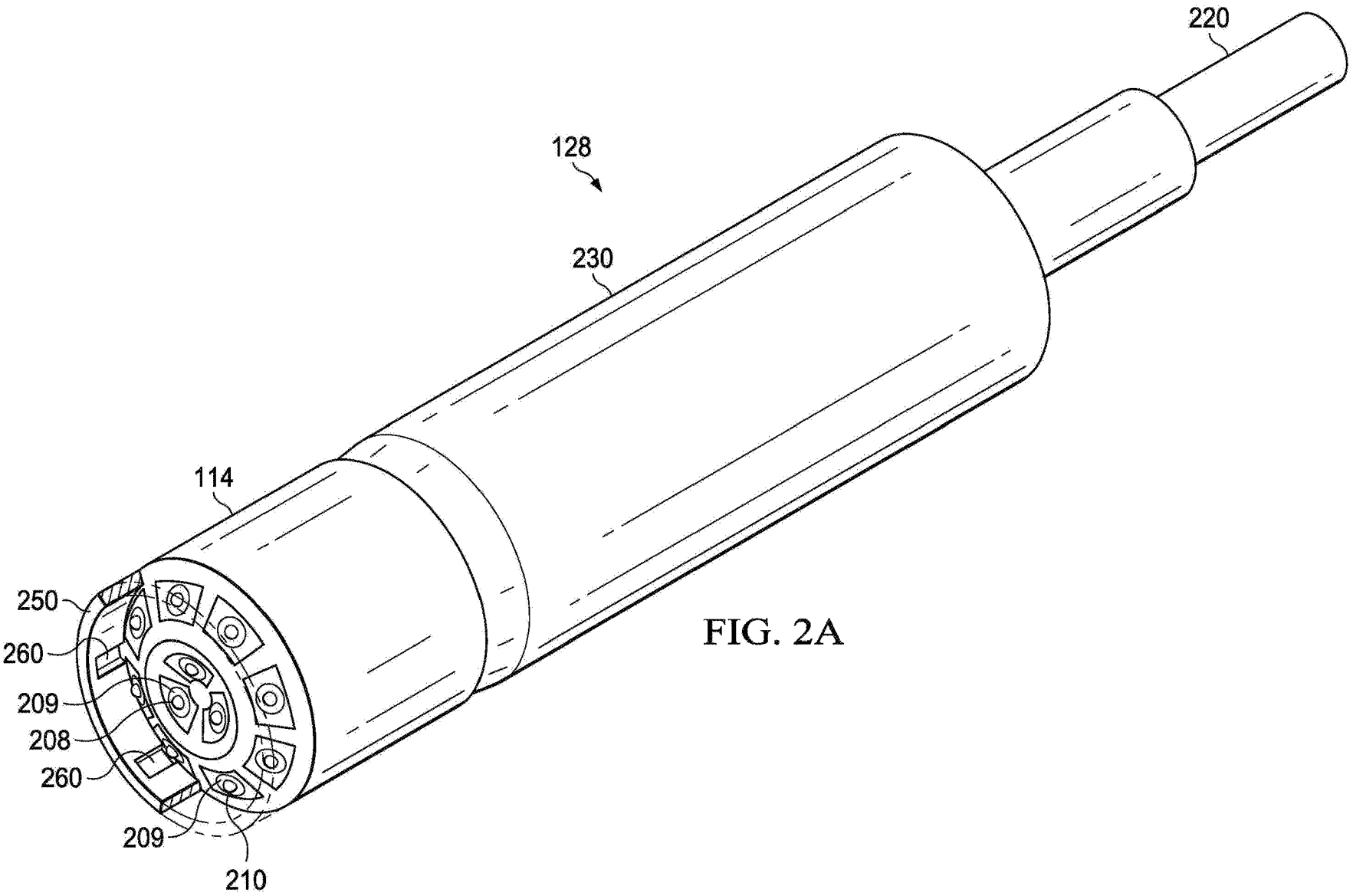
FIG. 2A is a perspective view of exemplary components of a bottom-hole assembly for a pulsed-power drilling system.

FIG. 2A is a perspective view of exemplary components of the bottom-hole assembly for a pulsed-power drilling system. BHA 128 may include pulsed-power tool 230 and drill bit 114. For the purposes of the present disclosure, drill bit 114 may be integrated within BHA 128, or may be a separate component coupled to BHA 128.

Pulsed-power tool 230 may provide pulsed electrical energy to drill bit 114. Pulsed-power tool 230 receives electrical power from a power source via cable 220. For example, pulsed-power tool 230 may receive electrical power via cable 220 from a power source located on the surface as described above with reference to FIG. 1, or from a power source located downhole such as a generator powered by a mud turbine. Pulsed-power tool 230 may also receive electrical power via a combination of a power source located on the surface and a power source located downhole. Drill bit 114 may include ground ring 250, shown in part in FIG. 2A. Ground ring 250 may function as an electrode. Pulsed-power tool 230 converts electrical power received from the power source into high-energy electrical pulses that are applied across electrodes 208 and ground ring 250 of drill bit 114. Pulsed-power tool 230 may also apply high-energy electrical pulses across electrode 210 and ground ring 250 in a similar manner as described for electrode 208 and ground ring 250. Pulsed-power tool 230 may include a pulse-generating circuit as described above in reference to FIG. 1.

Although illustrated as a contiguous ring in FIG. 2A, ground ring 250 may be non-contiguous discrete electrodes and/or implemented in different shapes. Each of electrodes 208 and 210 may be positioned at a minimum distance from ground ring 250 of approximately 0.4 inches and at a maximum distance from ground ring 250 of approximately 4 inches. The distance between electrodes 208 or 210 and ground ring 250 may be based on the parameters of the pulsed drilling operation and/or on the diameter of drill bit 114. For example, the distance between electrodes 208 or 210 and ground ring 250, at their closest spacing, may be at least 0.4 inches, at least 1 inch, at least 1.5 inches, or at least 2 inches.

Drilling fluid 122 is typically circulated through drilling system 100 at a flow rate sufficient to remove fractured rock from the vicinity of drill bit 114. In addition, drilling fluid 122 may be under sufficient pressure at a location in wellbore 116, particularly a location near a hydrocarbon, gas, water, or other deposit, to prevent a blowout. Drilling fluid 122 may exit drill string 108 via openings 209 surrounding each of electrodes 208 and 210. The flow of drilling fluid 122 out of openings 209 allows electrodes 208 and 210 to be insulated by the drilling fluid. A solid insulator (not expressly shown) may surround electrodes 208 and 201. Drill bit 114 may also include one or more fluid flow ports 260 on the face of drill bit 114 through which drilling fluid 122 exits drill string 108, for example fluid flow ports 260 on ground ring 250. Fluid flow ports 260 may be simple holes, or they may be nozzles or other shaped features. Because fines are not typically generated during pulsed-power drilling, as opposed to mechanical drilling, drilling fluid 122 may not need to exit the drill bit at as high a pressure as the drilling fluid in mechanical drilling. As a result, nozzles and other features used to increase drilling fluid pressure may not be needed on drill bit 114. However, nozzles or other features to increase drilling fluid 122 pressure or to direct drilling fluid may be included for some uses. Additionally, the shape of a solid insulator, if present, may be selected to enhance the flow of drilling fluid 122 around the components of drill bit 114.

If drilling system 100 experiences vaporization bubbles in drilling fluid 122 near drill bit 114, the vaporization bubbles may have deleterious effects. For instance, vaporization bubbles near electrodes 208 or 210 may impede formation of the arc in the rock. Drilling fluid 122 may be circulated at a flow rate also sufficient to remove vaporization bubbles from the vicinity of drill bit 114. Fluid flow ports 260 may permit the flow of drilling fluid 122 along with any fractured rock or vaporization bubbles away from electrodes 208 and 210 and uphole.

Figure 2B:
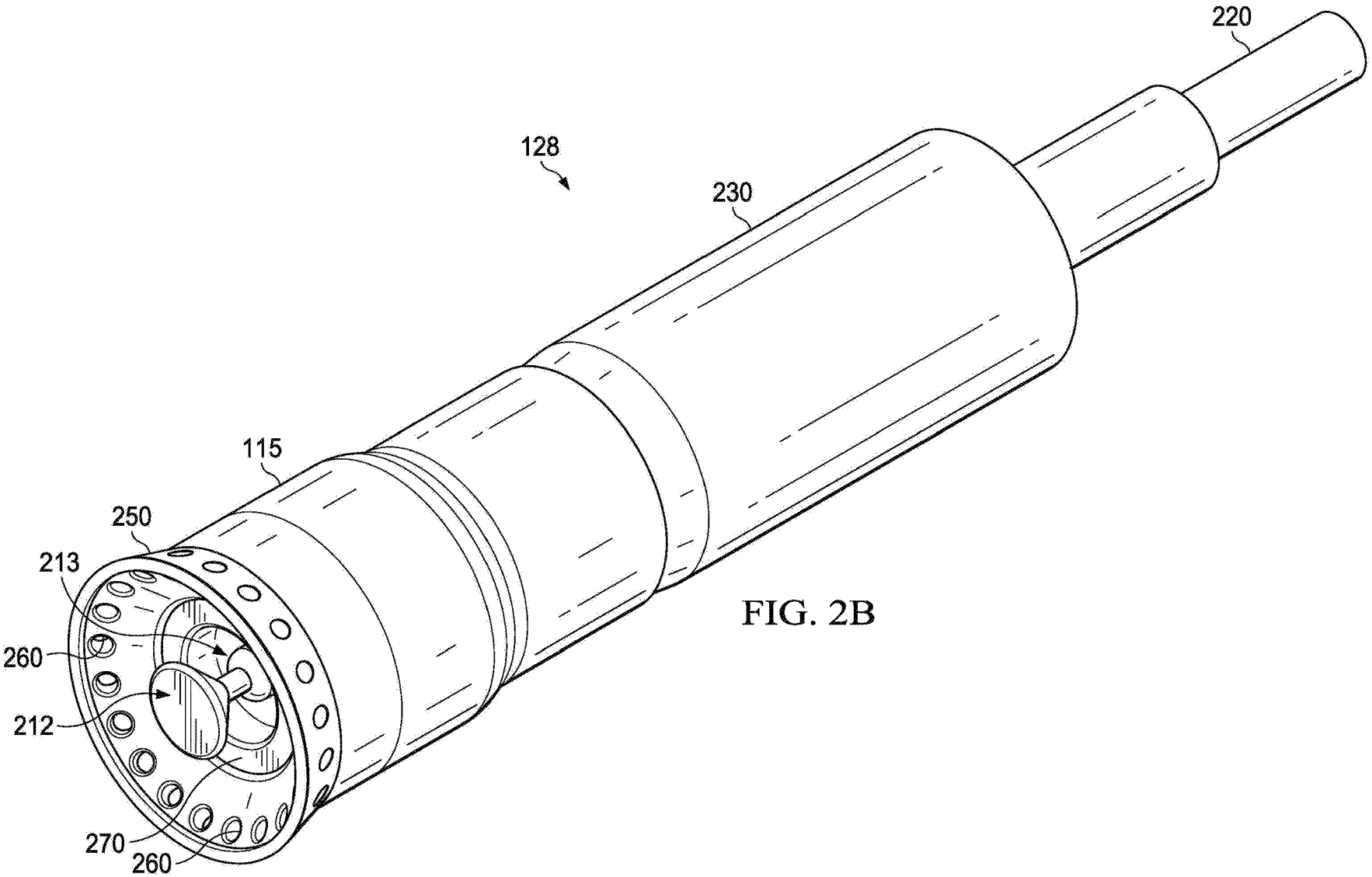
FIG. 2B is a perspective view of exemplary components of a bottom-hole assembly for a pulsed-power drilling system.

FIG. 2B is a perspective view of exemplary components of a bottom-hole assembly for a pulsed-power drilling system. BHA 128 may include pulsed-power tool 230 and drill bit 115. For the purposes of the present disclosure, drill bit 115 may be integrated within BHA 128, or may be a separate component that is coupled to BHA 128. BHA 128 and pulsed-power tool 230 may include features and functionalities similar to those discussed above in FIG. 2A.

Drill bit 115 may include bit body 255, electrode 212, ground ring 250, and solid insulator 270. Electrode 212 may be placed approximately in the center of drill bit 115. Electrode 212 may be positioned at a minimum distance from ground ring 250 of approximately 0.4 inches and at a maximum distance from ground ring 250 of approximately 4 inches. The distance between electrode 212 and ground ring 250 may be based on the parameters of the pulsed drilling operation and/or on the diameter of drill bit 115. For example, the distance between electrode 212 and ground ring 250, at their closest spacing, may be at least 0.4 inches, at least 1 inch, at least 1.5 inches, or at least 2 inches. The distance between electrode 212 and ground ring 250 may be generally symmetrical or may be asymmetrical such that the electric field surrounding the drill bit has a symmetrical or asymmetrical shape. The distance between electrode 212 and ground ring 250 allows drilling fluid 122 to flow between electrode 212 and ground ring 250 to remove vaporization bubbles from the drilling area. Electrode 212 may have any suitable diameter based on the pulsed drilling operation, on the distance between electrode 212 and ground ring 250, and/or on the diameter of drill bit 115. For example, electrode 212 may have a diameter between approximately 2 and approximately 10 inches (i.e., between approximately 51 and approximately 254 millimeters). Ground ring 250 may function as an electrode and provide a location on the drill bit where an electrical arc may initiate and/or terminate.

Drill bit 115 may include one or more fluid flow ports on the face of the drill bit through which drilling fluid exits the drill string 108. For example, ground ring 250 of drill bit 115 may include one or more fluid flow ports 260 such that drilling fluid 122 flows through fluid flow ports 260 carrying fractured rock and vaporization bubbles away from the drilling area. Fluid flow ports 260 may be simple holes, or they may be nozzles or other shaped features. Drilling fluid 122 is typically circulated through drilling system 100 at a flow rate sufficient to remove fractured rock from the vicinity of drill bit 115. In addition, drilling fluid 122 may be under sufficient pressure at a location in wellbore 116, particularly a location near a hydrocarbon, gas, water, or other deposit, to prevent a blowout. Drilling fluid 122 may exit drill string 108 via opening 213 surrounding electrode 212. The flow of drilling fluid 122 out of opening 213 allows electrode 212 to be insulated by the drilling fluid. Because fines are not typically generated during pulsed-power drilling, as opposed to mechanical drilling, drilling fluid 122 may not need to exit the drill bit at as high a pressure as the drilling fluid in mechanical drilling. As a result, nozzles and other features used to increase drilling fluid pressure may not be needed on drill bit 115. However, nozzles or other features to increase drilling fluid 122 pressure or to direct drilling fluid may be included for some uses. Additionally, the shape of solid insulator 270 may be selected to enhance the flow of drilling fluid 122 around the components of drill bit 115.

As described above with reference to FIGS. 1, 2A, and 2B, when the electric potential across electrodes of a pulsed-power drill bit becomes sufficiently large, an electrical arc forms through the rock formation and/or drilling fluid that is near the electrodes. The arc provides a temporary electrical short between the electrodes, and thus allows electric current to flow through the arc inside a portion of the rock formation and/or drilling fluid at the bottom of the wellbore. The arc increases the temperature of the portion of the rock formation through which the arc flows and the surrounding formation and materials. The temperature is sufficiently high to vaporize any water or other fluids that might be proximate to the arc and may also vaporize part of the rock itself. The vaporization process creates a high-pressure gas which expands and, in turn, fractures the surrounding rock.

Pulsed-power drilling systems and pulsed-power tools may utilize any suitable pulse-generating circuit topology to generate and apply high-energy electrical pulses across electrodes within the pulsed-power drill bit. Such pulse-generating circuit topologies may utilize electrical resonance to generate the high-energy electrical pulses required for pulsed-power drilling. The pulse-generating circuit may be shaped and sized to fit within the circular cross-section of pulsed-power tool 230, which as described above with reference to FIGS. 2A and 2B, may form part of BHA 128. The pulse-generating circuit may be enclosed within an encapsulant, such a thermally conductive material that protects the pulse-generating circuit from the wide range of temperatures (for example, from approximately 10 to approximately 200 degrees Centigrade) within the wellbore.

The pulsed-power drilling systems described herein may generate multiple electrical arcs per second using a specified excitation current profile that causes a transient electrical arc to form and arc through the most conducting portion of the wellbore floor. As described above, the arc causes that portion of the wellbore floor to disintegrate or fragment and be swept away by the flow of drilling fluid. As the most conductive portions of the wellbore floor are removed, subsequent electrical arcs may naturally seek the next most conductive portion. Therefore, obtaining measurements from which estimates of the excitation direction can be generated may provide information usable in determining characteristics of the formation.

Figure 3:
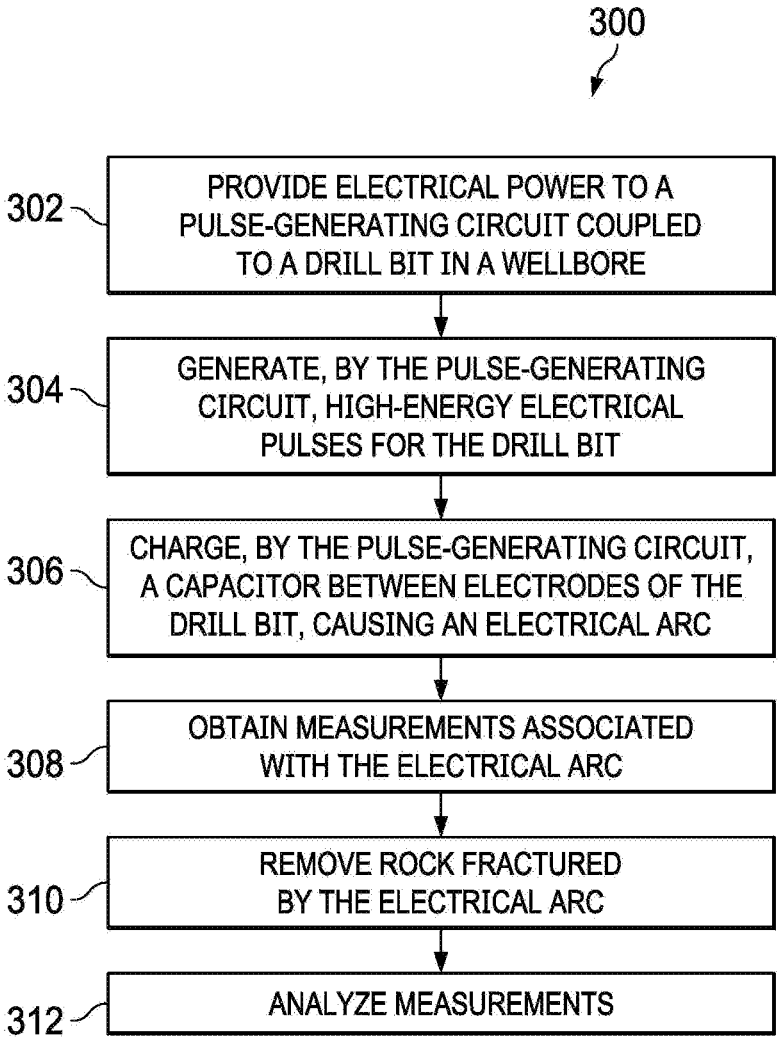
FIG. 3 is a flow diagram of an exemplary method for performing a pulsed drilling operation.

FIG. 3 is a flow chart illustrating an exemplary method 300 for performing a pulsed drilling operation using an electrocrushing drill bit or an electrohydraulic drill bit placed downhole in a wellbore. For example, drill bit 114 illustrated in FIG. 2A or drill bit 115 illustrated in FIG. 2B may be placed downhole in wellbore 116 as shown in FIG. 1. Method 300 includes, at 302, providing electrical power to a pulse-generating circuit coupled to the drill bit. For example, the pulse-generating circuit may be coupled to a first electrode and a second electrode of the drill bit. The first electrode may be electrode 208, 210, or 212 and the second electrode may be ground ring 250 discussed above with respect to FIGS. 2A and 2B. The pulse-generating circuit may be implemented within pulsed-power tool 230 shown in FIGS. 2A and 2B, and may receive electrical power from a power source on the surface, from a power source located downhole, or from a combination of a power source on the surface and a power source located downhole. Electrical power may be supplied downhole to a pulse-generating circuit by way of a cable, such as cable 220 described above with respect to FIGS. 2A and 2B. The power may be provided to the pulse-generating circuit within pulse-power tool 230 at a power source input.

At 304, high-energy electrical pulses are generated by the pulse-generating circuit for the drill bit by converting the electrical power received from the power source into high-energy electrical pulses. For example, the pulse-generating circuit may use electrical resonance to convert a low-voltage power source (for example, approximately 1 kV to approximately 5 kV) into high-energy electrical pulses capable of applying at least 150 kV across electrodes of the drill bit.

At 306, the pulse-generating circuit charges a capacitor between electrodes of the drill bit, causing an electrical arc.

For example, a switch located downhole within the pulse-generating circuit may close to charge a capacitor that is electrically coupled between the first electrode and the second electrode. The switch may close to generate a high-energy electrical pulse and may be open between pulses. The switch may be a mechanical switch, a solid-state switch, a magnetic switch, a gas switch, or any other type of switch. Accordingly, as the voltage across the capacitor increases, the voltage across the first electrode and the second electrode increases. As described above with reference to FIGS. 1, 2A and 2B, when the voltage across the electrodes becomes sufficiently large, an electrical arc may form through the drilling fluid and/or a rock formation that is proximate to the electrodes. The arc may provide a temporary electrical short between the electrodes, and thus may discharge, at a high current level, the voltage built up across the capacitor.

At 308, measurements representing the recorded responses are obtained. For example, one or more acoustic, electrical and/or electromagnetic sensors may record responses to received signals including, but not limited to, high-energy electrical pulses, electrical arcs, or acoustic and/or electromagnetic waves produced by the electrical arc during a pulsed drilling operation, and may provide measurements representing the recorded responses to a sensor analysis system, such as sensor analysis system 150 illustrated in FIG. 1 or sensor analysis system 500 illustrated in FIG. 5.

As described above with reference to FIGS. 1, 2A and 2B, the electrical arc greatly increases the temperature of the portion of the rock formation through which the arc flows as well as the surrounding formation and materials, such that the rock formation at the bottom of the wellbore may be fractured with the electrical arc. The temperature may be sufficiently high to vaporize any water or other fluids that may be touching or near the arc and may also vaporize part of the rock itself. The vaporization process creates a high-pressure gas which expands and, in turn, fractures the surrounding rock. At 310, rock fractured by the electrical arc may be removed from the end of the wellbore. For example, as described above with reference to FIG. 1, drilling fluid 122 may move the fractured rock away from the electrodes and uphole from the drill bit. As described above with respect to FIGS. 2A and 2B, drilling fluid 122 and the fractured rock may flow away from electrodes through fluid flow ports 260 on the face of the drill bit or on a ground ring of the drill bit.

At 312, the measurements obtained at 308 are analyzed to determine characteristics of the rock formation or for other purposes. For example, a sensor analysis system, such as sensor analysis system 150 in FIG. 1, may use measurements, such as a voltage, current, ratio of voltage to current, or magnetic field strength representing one or more responses recorded by one or more sensors, to determine the dielectric value around the pulsed-power drill bit. The analysis may include one or more inversions, as described with respect to FIG. 6, FIG. 11, and/or FIG. 12.

Modifications, additions, or omissions may be made to method 300 without departing from the scope of the disclosure. For example, the order of the steps may be performed in a different manner than that described and some steps may be performed at the same time. Additionally, each individual step may include additional steps without departing from the scope of the present disclosure. The operations of method 300 illustrated in FIG. 3 may be repeated, as needed, to perform a pulsed drilling operation.

Figure 4:
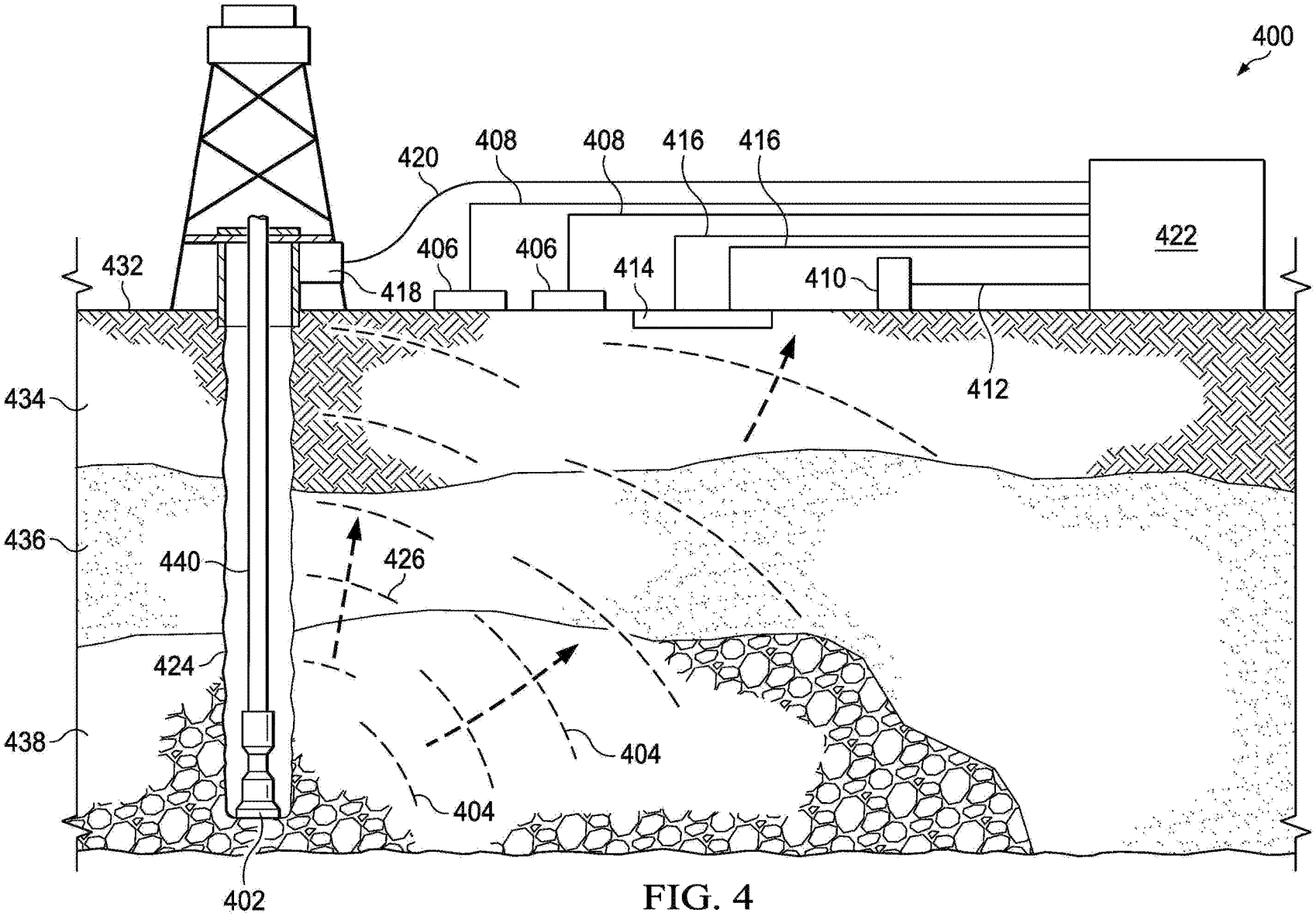
FIG. 4 is a block diagram illustrating an elevation view of an exemplary measurement system for pulsed-drilling.

FIG. 4 is an elevation view of an exemplary measurement system associated with a pulsed drilling system. Measurement system 400 may include sensor analysis system 422 that receives data from one or more of sensors 406, 410, 414 and 418 via one or more of interfaces 408, 412, 416, and 420. A pulsed-power drilling system may include a pulsed-power drill bit 402 that is located at the distal end of wellbore 424. During a pulsed drilling operation, electromagnetic waves 404 and acoustic waves 426 may be created by electric arcs formed proximate to drill bit 402. Electromagnetic waves 404 may propagate through one or more of subterranean layers 438, 436, 434 before reaching surface 432. Acoustic waves 426 may propagate through one or more subterranean layers and uphole along wellbore 424 from drill bit 402 to surface 432 and travel through one or more of subterranean layers 438, 436, 434. One or more of sensors 406, 410, 414 and 418 may be located in wellbore 424 or on surface 432. The sensors may be located a known distance from drill bit 402. The sensors may record responses to received signals including, but not limited to, high-energy electrical pulses, electrical arcs, electromagnetic waves 404 and/or acoustic waves 426 created during a pulsed drilling operation. The sensors may send one or more measurements representing the recorded responses to sensor analysis system 422, which analyzes the measurements. One or more components of sensor analysis system 422 may be located on surface 432, in wellbore 424, and/or at a remote location. For example, sensor analysis system 422 may include a measurement processing subsystem in wellbore 424 that processes measurements provided by one or more of the sensors and transmits the results of the processing uphole to another component of sensor analysis system 422 for storage and/or further processing.

During a pulsed drilling operation, high-energy electrical pulses are applied to the electrodes of drill bit 402 to build up electric charge at the electrodes. The rock in the surrounding formation fractures when an electrical arc forms at drill bit 402. Electromagnetic waves 404 are created by the current associated with the electrical arc and/or the electric charge built up on the electrodes of drill bit 402. In addition, acoustic waves 426 are created by the electrical arc and subsequent fracturing of rock in the formation proximate to the drill bit.

The duration of an electrical arc created during a pulsed drilling operation may be approximately 100 μs. The duration of the electrical arc may be shorter than the duration of the high-energy electrical pulses that are applied to the electrodes of drill bit 402, which may repeat on the order of several to a few hundred hertz. Because the duration of the electrical arc is less than the repetition period of the pulses, electrical arcs that are generated at drill bit 402 may be represented by a series of impulses in which each impulse has a corresponding electromagnetic wave and acoustic wave. The time at which the impulse occurs may be used to measure, map, and/or image subterranean features. If the repetition period of the series of impulses is Ts, the Fourier transform of the impulses in the frequency domain consists of impulses occurring at multiples of a base frequency (f0) equal to $2n\pi/Ts$. If drill bit 402 provides pulses at a constant frequency, a range of corresponding discrete frequencies (e.g., f0, 2f0, 3f0) are generated in the frequency domain. The discrete frequencies may be used to measure, map, and/or image subterranean features.

Electromagnetic waves 404 and/or acoustic waves 426 originate from and/or in proximity to drill bit 402 at the distal end of wellbore 424 and propagate outward. For example, electromagnetic waves 404 and/or acoustic waves 426 may propagate through one or more of subterranean layers 438, 436, and/or 434. Although FIG. 4 illustrates a formation having three layers, the subterranean region may include any number of layers and/or formations suitable for pulsed drilling. Electromagnetic waves 404 and/or acoustic waves 426 created at and/or in proximity to drill bit 402 may propagate from layer 438 to the surface 432 via layers 434 and/or 436. Although electromagnetic waves 404 and acoustic waves 426 are illustrated in FIG. 4 as propagating in certain directions, electromagnetic waves 404 and acoustic waves 426 may propagate in any direction.

Sensors 406, 410, and/or 414 may record responses to received signals including, but not limited to high-energy electrical pulses, electrical arcs, or electromagnetic and/or acoustic waves. Each of the sensors may include an antenna. For example, sensors 406 and 410 may include linear dipole antennas and sensor 414 may include a loop antenna. Linear dipole antennas may be used to record responses to electric fields, including electric fields propagating from drill bit 402. Linear dipole antennas may be oriented in various directions to record responses to electric fields with varying polarizations, while loop antennas may be used to record responses to magnetic fields. For example, the linear dipole antenna in sensor 406 may be oriented parallel to the propagation of electromagnetic waves 404, while the linear dipole antenna in sensor 410 may be oriented perpendicular to the propagation of electromagnetic waves 404. Although three electromagnetic sensors are illustrated, measurement system 400 may include any number of sensors of any suitable type to record responses to an electric and/or magnetic field. The sensors may be oriented in any suitable direction to record responses to an electric and/or magnetic field with any polarization. For example, a sensor may include a coaxial or tilted coil antenna to record responses to electromagnetic data. As another example, the sensor may be a magnetometer for recording responses to the magnetic field. As a further example, the sensor may be an electric sensor, such as a sensor with a monopole antenna, dipole antenna, or pair of electrodes that are spaced apart. The sensor may be rotated around the centerline of a bottom hole assembly (BHA) of a wellbore, such as wellbore 424, to provide information about the formation at various azimuthal positions. Measurement system 400 may use more than one sensor simultaneously to provide polarization diversity with antennas oriented in different directions.

Sensors 406, 410 and/or 414 may convert the recorded responses into measurements and send the measurements to sensor analysis system 422. The measurements may be digital representations of the recorded responses. Sensor 406 may be communicatively coupled via interface 408 to sensor analysis system 422, sensor 410 may be communicatively coupled via interface 412 to sensor analysis system 422, and sensor 414 may be communicatively coupled via interface 416 to sensor analysis system 422. Each sensor may provide differential or single-ended measurement data to sensor analysis system 422 via an interface. For example, sensor 406 is illustrated with interface 408 having two sub-interfaces to transmit differential measurement data to sensor analysis system 422.

Sensor analysis system 422 may receive measurements from one or more of sensors 406, 410 and 414, and store the measurements as a function of pulse index and time or frequency. The pulse index may begin at one and be incremented each time a new pulse is generated at drill bit 402 during a pulsed drilling operation. The measurements may be represented in the time domain or the frequency domain. In the time-domain, sensors 406, 410 and 414 may measure electromagnetic waves by determining a voltage or current and may measure acoustic waves by determining a pressure or displacement. In the frequency domain, a sensor may measure the amplitude and phase by recording responses to the received signal, such as a steady state monochromatic signal, or by performing a Fourier transform of the signal, such as a wide band signal.

Acoustic waves 426 originate at or near drill bit 402 and propagate uphole along wellbore 424 to surface 432 during a pulsed drilling operation. Sensor 418 may be located proximate to surface 432 and may record responses to the acoustic wave to provide measurements to sensor analysis system 422 via interface 420 such that sensor analysis system 422 may calculate the time of when the electrical arc is formed. Each acoustic wave may travel uphole to the surface along the casing of wellbore 424 and drill string 440 at a known velocity. For example, the acoustic wave travels at a velocity of approximately 5000 m/s if the casing and drill string 440 are formed of steel. Other materials suitable for pulsed drilling with known acoustic propagation velocities may be used for the casing and drill string 440. For example, the acoustic propagation velocity is between 50 and 2000 m/s for rubber, on the order of 5000 m/s for titanium, and on the order of 4000 m/s for iron. The time of the formation of the electrical arc may be determined based on the known propagation velocity of the material used to form the casing and drill string 440 and the distance between surface 432 and drill bit 402. The distance between drill bit 402 and surface 432 may be determined by depth and position information generated by known downhole survey techniques for vertical drilling, directional drilling, multilateral drilling, and/or horizontal drilling.

Although FIG. 4 illustrates one acoustic sensor at the surface, any number of acoustic sensors suitable to measure, map, and/or image subterranean features may be positioned at one or more locations on the surface or elsewhere. For example, an array of acoustic sensors may be used within the wellbore. The acoustic sensors in the array may be positioned at different locations within the wellbore, and may be oriented in different directions to record responses to propagating acoustic waves. The array may provide information about the surrounding formation at various depths sufficient for sensor analysis system 422 to form a three-dimensional image of the surrounding subterranean features.

The equipment shown in FIG. 4 may be land-based or non-land based equipment or tools that incorporate teachings of the present disclosure. For example, some or all of the equipment may be located on offshore platforms, drill ships, semi-submersibles, or drilling barges (not expressly shown). Additionally, while the wellbore is shown as being a generally vertical wellbore, the wellbore may be any orientation including generally horizontal, multilateral, or directional.

Sensor analysis system 422 may process measurements received from sensors 406, 410, 414 and/or 418 to determine one or more values for the dielectric constant proximate to drill bit 402. The values for the dielectric constant may be used to determine the relative amount of water and hydrocarbon in the formation, the water filled porosity and/or salinity of water in the formation, and/or a different drilling fluid for pulsed-power drilling.

FIG. 5 is a block diagram illustrating an exemplary sensor analysis system associated with a pulsed-power drilling system. Sensor analysis system 500 may be positioned at the surface for use with pulsed-power drilling system 100 as illustrated in FIG. 1, or at any other suitable location. Sensor analysis system 500 may be configured to determine one or more values for the dielectric constant proximate to the drill bit including, but not limited to the dielectric constant of the drilling fluid and/or the dielectric constant of a portion of the formation proximate to the drill bit, a dielectric change, an average direction of electrical arcs, and/or a dielectric distribution proximate to the drill bit.

In the illustrated embodiment, sensor analysis system 500 may include a processing unit 510 coupled to one or more input/output interfaces 520 and data storage 518 over an interconnect 516. Interconnect 516 may be implemented using any suitable computing system interconnect mechanism or protocol. Processing unit 510 may be configured to determine one or more values for the dielectric constant based, at least in part, on inputs received by input/output interfaces 520, some of which may include measurements representing responses recorded by various sensors within a wellbore, such as voltages, currents, ratios of voltages to current, or magnetic fields detected by one or more sensors. For example, processing unit 510 may be configured to perform one or more inversions to determine one or more values for the dielectric constant proximate the pulsed-power drill bit based on measurements within a pulsed-power drilling wellbore.

Processing unit 510 may include processor 512 that is any system, device, or apparatus configured to interpret and/or execute program instructions and/or process data associated with sensor analysis system 500. Processor 512 may be, without limitation, a microprocessor, microcontroller, digital signal processor (DSP), application specific integrated circuit (ASIC), or any other digital or analog circuitry configured to interpret and/or execute program instructions and/or process data. In some embodiments, processor 512 may interpret and/or execute program instructions and/or process data stored in one or more computer-readable media 514 included in processing unit 510 to perform any of the methods described herein.

Computer-readable media 514 may be communicatively coupled to processor 512 and may include any system, device, or apparatus configured to retain program instructions and/or data for a period of time (e.g., computer-readable media). Computer-readable media 514 may include random access memory (RAM), read-only memory (ROM), solid state memory, electrically erasable programmable read-only memory (EEPROM), disk-based memory, a PCMCIA card, flash memory, magnetic storage, opto-magnetic storage, or any suitable selection and/or array of volatile or non-volatile memory that retains data after power to processing unit 510 is turned off. In accordance with some embodiments of the present disclosure, computer-readable media 514 may include instructions for determining one or more characteristics of a formation, such as formation 118 in FIG. 1, or the dielectric constant around the pulsed-power drill bit based on signals received from various sensors by input/output interfaces 520.

As described above, input/output interfaces 520 may be coupled to an optical fiber over which it may send and receive signals. Signals received by input/output interfaces 520 may include measurements representing responses recorded by various sensors at the surface or downhole during a pulsed drilling operation. For example, signals received by input/output interfaces 520 may include measurements representing responses recorded by electrical or electromagnetic sensors. These measurements may include, without limitation, measurements of voltage, current, electric field strength, or magnetic field strength.

Data storage 518 may provide and/or store data and instructions used by processor 512 to perform any of the methods described herein for collecting and analyzing data from electrical or electromagnetic sensors. In particular, data storage 518 may store data that may be loaded into computer-readable media 514 during operation of sensor analysis system 500. Data storage 518 may be implemented in any suitable manner, such as by functions, instructions, logic, or code, and may be stored in, for example, a relational database, file, application programming interface, library, shared library, record, data structure, service, software-as-service, or any other suitable mechanism. Data storage 518 may store and/or specify any suitable parameters that may be used to perform the described methods. For example, data storage 518 may provide information used to direct components of sensor analysis system 500 to analyze measurements representing responses recorded by various electrical or electromagnetic sensors during a pulsed drilling operation to determine one or more characteristics of a formation, such as formation 118 as shown in FIG. 1, or one or more values for the dielectric constant proximate the pulsed-power drill bit. Information stored in data storage 518 may also include one or more models generated or accessed by processing unit 510. For example, data storage 518 may store a statistical model for a source of electrical arcs or a model used in an inversion process, as described with respect FIG. 6.

The elements shown in FIG. 5 are exemplary only and sensor analysis system 500 may include fewer or additional elements in other embodiments. Modifications, additions, or omissions may be made to sensor analysis system 500 without departing from the scope of the present disclosure. For example, sensor analysis system 500 illustrates one particular configuration of components, but any suitable configuration of components may be used. Components of sensor analysis system 500 may be implemented either as physical or logical components. Furthermore, in some embodiments, functionality associated with components of sensor analysis system 500 may be implemented with special and/or general purpose circuits or components. Components of sensor analysis system 500 may also be implemented by computer program instructions.

Figure 6:
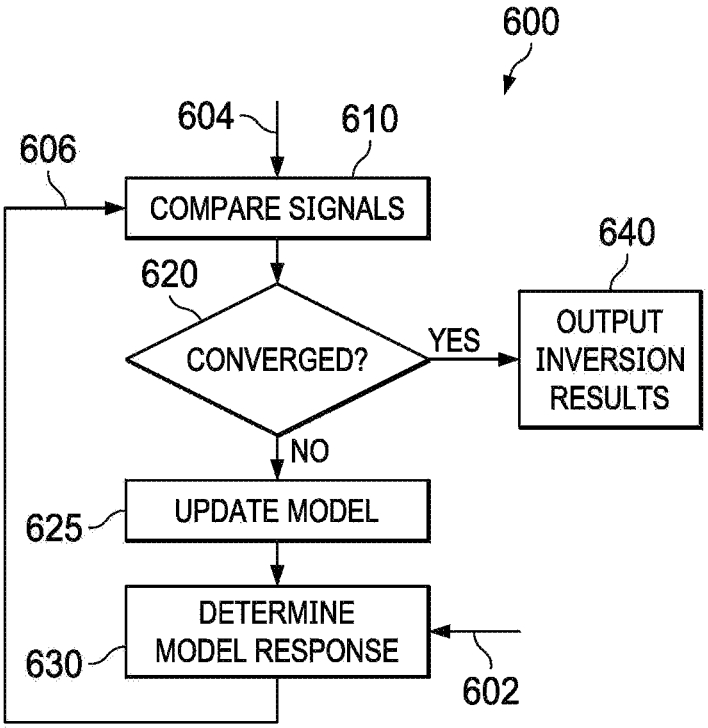
FIG. 6 is a flow diagram illustrating an exemplary inversion process.

FIG. 6 is a flow diagram illustrating an exemplary inversion process. In this example, inputs to inversion process 600 include model generation inputs 602, estimated signals 606, and received signals 604. Model generation inputs 602 may include initial estimates of one or more values for the dielectric constant between one or more electrodes. For example, the initial estimate may be the effective dielectric constant ($\varepsilon_{r,eff}$) as shown in equation (5) for the description of FIG. 10. In addition, model generation inputs 602 may include initial estimates of a value for the dielectric constant at an arbitrary azimuth, as described for FIG. 10. Model generation inputs 602 may be used to determine a model response, as shown in 630, including various model parameters and estimated signals 606. For example, the model response may include electrical and/or magnetic properties associated with a model of a capacitor, such as a parallel-plate capacitor or a cylindrical capacitor, a model of the dielectric constant for the formation and/or drilling fluid, and/or a model of the drill bit geometry. Estimated signals 606 may include initial estimates of one or more values for the dielectric constant. Estimated signals 606 may be estimated with respect to the azimuth. Received signals 604 include any combination of unmodified measurements representing responses recorded by various electrical or electromagnetic sensors, and/or measurements derived from raw information recorded by the sensors, for example responses that have been normalized or otherwise modified as described herein. Received signals may include one or more measurements, such as a voltage, a current, ratio of a voltage to a current, or a magnetic field, of the electromagnetic waves or the electrical flow of charge created during a pulsed-power drilling operation. The measurement may represent a value in the time or frequency domain. In the frequency domain, for example, absolute values of received signals 604 may be used at discrete frequencies. As another example, the ratios of received signals 604 at different frequencies may be used in the inversion. The ratio of received signals 604 may reduce or filter out any undesirable factor in received signals 604, such as the borehole effect or amplitude and/or phase fluctuations in the excitation of the electrical pulse or electric arc. The inversion may consider the ratio of received signals 604 at different frequencies to be one received signal at one frequency.

As shown at 610, received signals 604 may be compared with estimated signals 606 to determine whether there is a mismatch between received signals 604 and estimated signals 606. If at 620 there is a mismatch between the signals, rather than a convergence, the model parameters may be updated, as shown in 625, and an updated model response may be determined, as shown in 630. When and if there is convergence between received signals 604 and estimated signals 606, the results of the inversion process may be output, as shown in 640. For example, if a match is found between a model response for the electrical and/or magnetic properties associated with a model of a capacitor and received signals 604, the resultant value for the dielectric constant representing the actual dielectric constant between one or more pairs of electrodes of the pulsed-power drill bit may be output.

Figure 7:
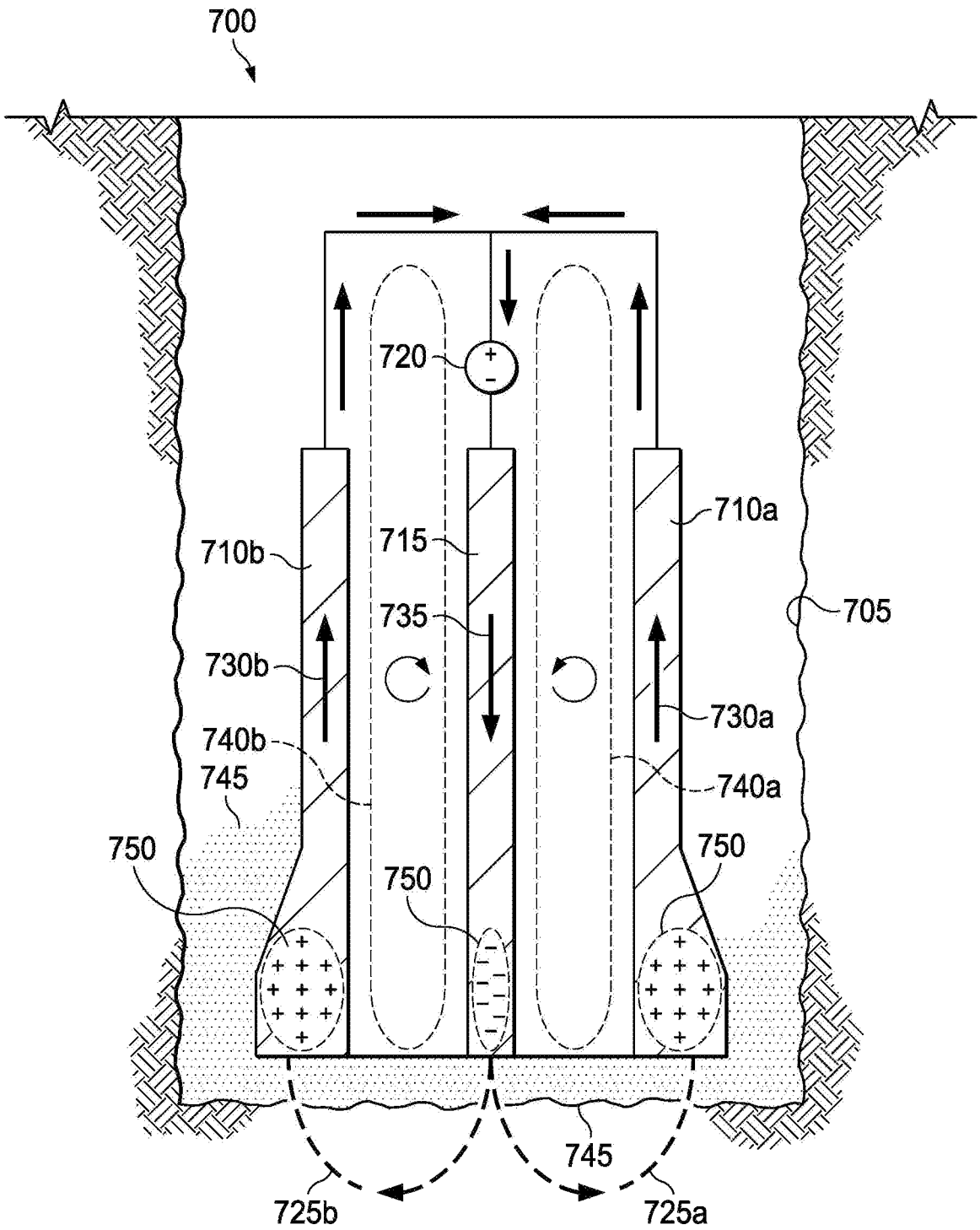
FIG. 7 is a block diagram illustrating an exemplary model for a source of electrical arcs.

FIG. 7 is a block diagram illustrating an exemplary model for a source of electrical arcs. The model may be used in an inversion, as described with respect to FIG. 6. In the pulsed-power drilling systems described herein, electrical arcs do not have rotational symmetry around a centerline of the bottom-hole assembly (BHA) and individual electrical arcs may occur at random azimuthal locations between electrodes of a drill bit. A toroidal source model may be used to statistically estimate the excitation of the electrical arcs. More specifically, the toroidal source model may be used to generate a time-averaged signal that is the same as the measurements representing responses recorded by the electrical or electromagnetic sensors. The receiving sensors may record responses to received signals including, but not limited to high-energy electrical pulses, electrical arcs, or electromagnetic waves produced by the electrical arcs. The receiving sensors or arrays of such sensors may perform statistical averaging by recording responses to the received signals over a certain period of time. For example, hundreds of excitation pulses may be averaged at the receiving sensor. A moving average may be performed in real time, since recording all signals and averaging them in post-processing may be cost or space prohibitive in the BHA environment.

An equivalent excitation of the electrical arcs that generates the same signal as a time-averaged signal generated at the receiving sensors, modeled as a toroidal pulse source model 700, is illustrated in FIG. 7. In the example embodiment illustrated in FIG. 7, it is assumed that individual electrical arcs may form at random locations on the pulsed-power drill bit. For example, electrical arcs may form between electrodes 208 and 210 as illustrated in FIG. 2A or between electrode 212 and ground ring 250 as illustrated in FIG. 2B. Many such arcs may occur consecutively in time, with a frequency and intensity determined by the pulse scheme used for the drilling operation. The surrounding formation and the receiving sensors may behave linearly with the electrical arc excitation and the locations of the arcs and their random amplitude fluctuations may be time-averaged at the receiving sensors to arrive at the equivalent toroidal pulse source model 700.

Model 700, which may be referred to as an equivalent deterministic source model, includes voltage source 720, and one or more electrodes as shown in FIGS. 2A and 2B. The voltage source may provide charge 750 on the end of electrodes 715, 740*a*, and 740*b* via high-energy electrical pulses. In this equivalent deterministic source model, constant-amplitude pulsed currents 735 flow downhole uniformly over the center electrode 715, pass through the formation and/or drilling fluid 745 along a semi-toroidal surface represented by currents 725*a* and 725*b*, and flow uphole uniformly along the outer wall of the drill bit at 710*a* and 710*b* as currents 730*a* and 730*b*. The two opposite paths of the current flow are indicated by dashed loops 740*a* and 740*b* shown in the annular region between the center electrode 715 and the outer wall represented by 710*a* and 710*b*. In this equivalent deterministic source model, both the BHA and the current paths have rotational symmetry around the BHA axis. The toroidal source may behave like an electric dipole oriented parallel to the BHA.

Figure 8B:
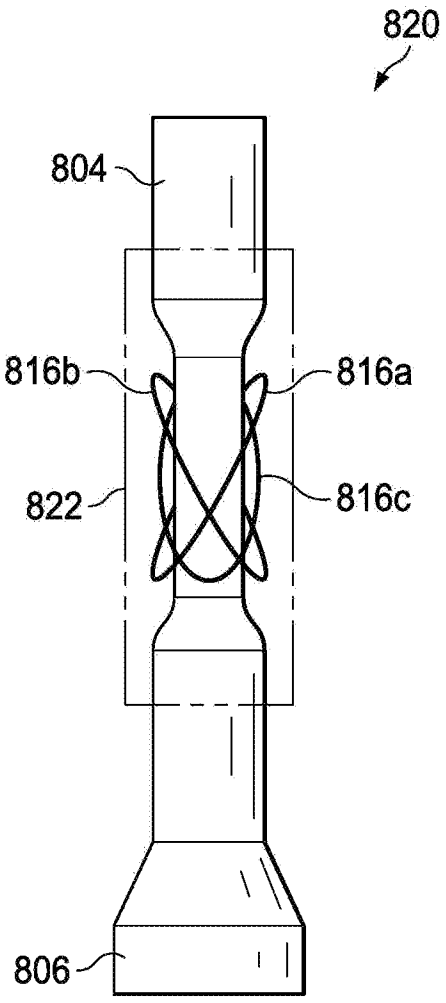
FIG. 8B is an elevation view of exemplary components of a measurement system including multiple antennas that are associated with the bottom-hole assembly (BHA) of the pulsed-power drilling system.
Figure 8A:
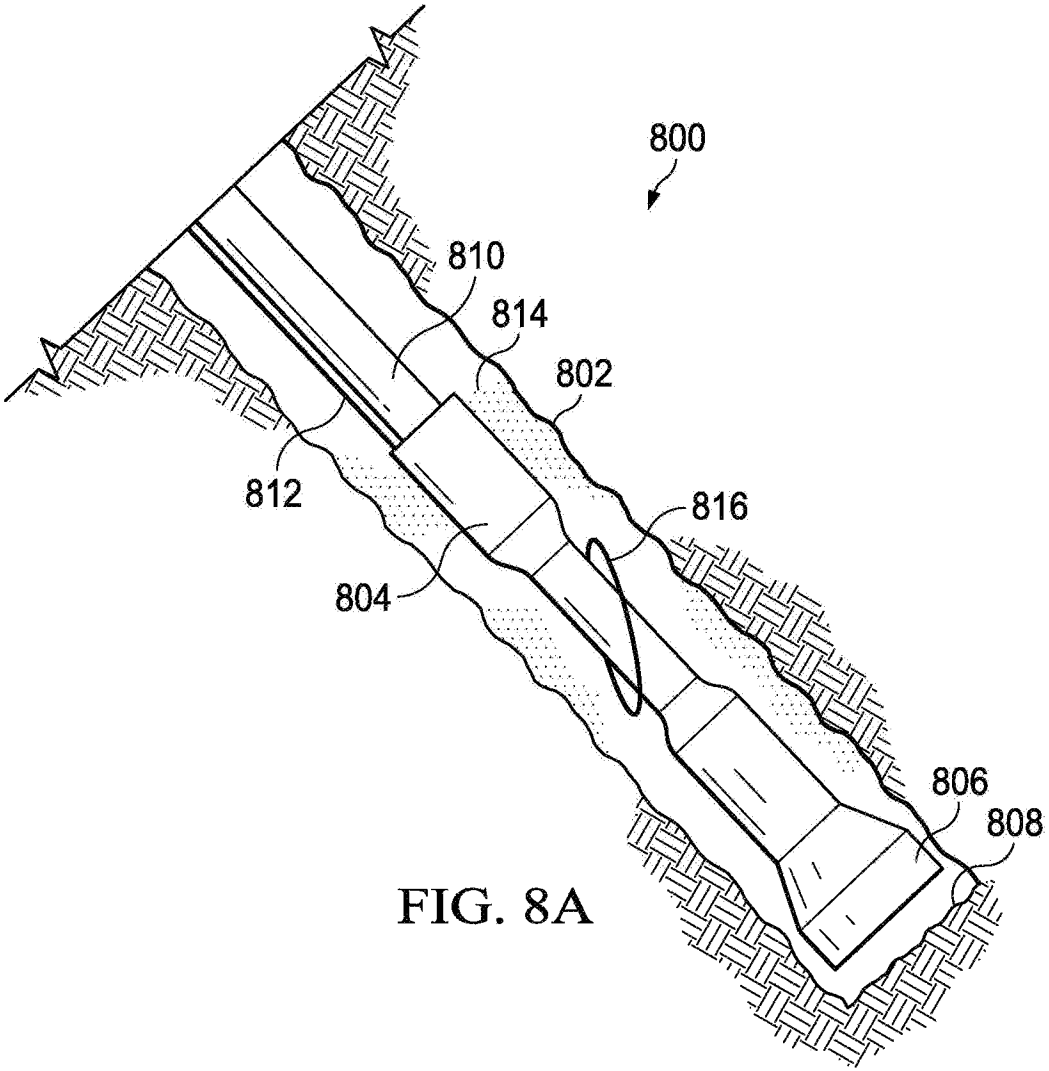
FIG. 8A is an elevation view of exemplary components of a measurement system including a single antenna that is associated with the bottom-hole assembly (BHA) of the pulsed-power drilling system.

FIG. 8A is an elevation view of exemplary components of a drilling system including a sensor associated with the bottom-hole assembly (BHA) of the drilling system. Drilling system 800 may include pulsed-power drill bit 806, bottom-hole assembly (BHA) 804, and drill string 810. Drill bit 806 may receive power via cable 812 to provide high-energy electrical pulses to the electrodes (not expressly shown) of drill bit 806. The high-energy electrical pulses create electrical arcs through formation 808 surrounding wellbore 802. The electrical arcs fracture rock in formation 808, which is carried away by drilling fluid 814. In addition to causing the rock to fracture, the electrical arcs generate electromagnetic waves that may be measured by sensor 816.

Sensor 816 may be communicatively coupled to a sensor analysis system, such as sensor analysis system 150 in FIG. 1, sensor analysis system 422 in FIG. 4, or sensor analysis system 500 in FIG. 5. Power may be delivered to sensor 816 by, for example, cable 812. As another example, sensor 816 may be powered by a battery (not expressly shown). As a further example, sensor 816 may receive power by a laser (not expressly shown) through an optical fiber deployed downhole, such as optical fiber 160 in FIG. 1. A conversion unit, such as a photovoltaic cell, within bottom-hole assembly 804 may convert light from the laser into electrical energy to power sensor 816.

Sensor 816 may include an antenna that is tilted as shown or that is coaxially oriented. Sensor 816 may receive a signal representing the electromagnetic wave created during a pulsed drilling operation and record responses at a particular orientation. The antenna of sensor 816 may be rotated along the centerline of BHA 804 in order for sensor 816 to record responses at different orientations. For example, the antenna in sensor 816 may be rotated to different azimuthal positions of approximately 0, 90, 180, and 270 degrees. Any number of responses at different azimuthal positions may be recorded to generate two-dimensional information about the surrounding formation including, but not limited to, the average direction of electrical arcs. The antenna of sensor 816 may be rotated in any suitable manner for taking measurements. For example, if sensor 816 includes a tilted coil, the tilted coil may be rotated by rotating BHA 804 using drill string 810. Although the rotation of BHA 804 may increase interference with recorded responses of low-frequency electromagnetic waves, such as electromagnetic waves having a frequency of approximately 100 Hz and below, the exemplary tilted coil may be azimuthally sensitive to electromagnetic waves having a frequency above approximately 100 Hz. As another example, a motor located proximate the antenna of sensor 816 may rotate the antenna at a rate independent of the rate at which BHA 804 may or may not rotate during a pulsed-power drilling operation. Sensor 816 may record responses to the electromagnetic waves and send measurements to a sensor analysis system to determine information about the surrounding formation, such as the dielectric constant of the formation, resistivity of the formation, magnetic permeability of the formation, resistivity anisotropy of the formation, layer positions, density of the formation, compressional velocity of the formation, shear velocity of the formation, or the bed boundaries around and ahead of drill bit 806.

Figure 9B:
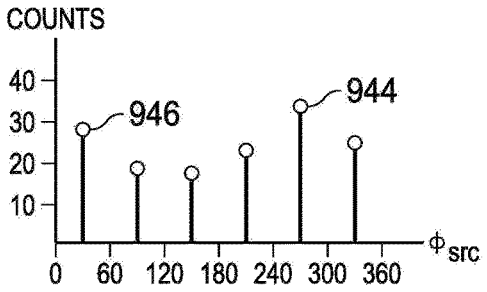
FIG. 9B is a graph illustrating bins with responses from multiple sensors azimuthally distributed around a centerline of the bottom-hole assembly (BHA) of the pulsed-power drilling system.

FIG. 8B is an elevation view of exemplary components of a drilling system including multiple sensors associated with a bottom-hole assembly (BHA) of the drilling system. Drilling system 820 may include pulsed-power drill bit 806, bottom-hole assembly (BHA) 804, and drill string 810. Similar to drilling system 800 in FIG. 8A, high-energy electrical pulses may be provided to the electrodes (not expressly shown) of drill bit 806 to create electrical arcs through the formation 808 surrounding the wellbore (not expressly shown). The electrical arcs fracture rock in the formation and generate electromagnetic and/or acoustic waves that may be measured by sensor assembly 822. Sensor assembly 822 may be communicatively coupled to a sensor analysis system, such as sensor analysis system 422 in FIG. 4. For example, sensors 816*a*, 816*b*, and 816*c* may be housed within one or more sensor assemblies. Each sensor may include an antenna, such as a tilted coil as shown. The antennas within sensor assembly 822 may be of the same or different types. The antennas of sensors 816*a*, 816*b*, and 816*c* may be oriented with different azimuthal directions to allow for azimuthal sensitivity to the electromagnetic waves emitted during pulsed-power drilling operation. Responses may be recorded by each of the sensors, which may convert the responses into measurements that are sent to a sensor analysis system. Measurements representing these responses may subsequently be used by the sensor analysis system to determine an excitation direction in terms of an azimuth angle. For example, the measurements may be organized in a series of bins that correspond to the received azimuthal direction of the electrical arcs, as shown in FIG. 9B.

Figure 8C:
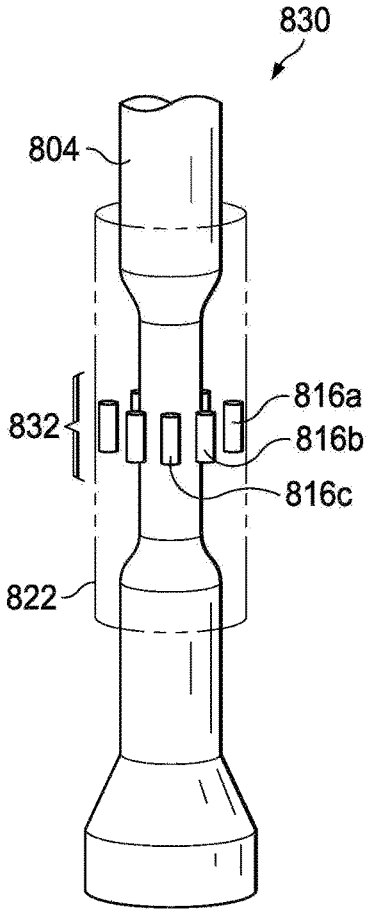
FIG. 8C is an elevation view of exemplary components of a measurement system including multiple magnetometers that are associated with the bottom-hole assembly (BHA) of the pulsed-power drilling system.

FIG. 8C is an elevation view of exemplary components of a drilling system including multiple magnetometers associated with a bottom-hole assembly (BHA) of the drilling system. Drilling system 830 may include a pulsed-power drill bit (not expressly shown), a bottom-hole assembly (BHA) 804, and drill string 812. Similar to drilling system 800 in FIG. 8A, high-energy electrical pulses may be provided to the electrodes the drill bit to create electrical arcs through formation 808 surrounding the wellbore (not expressly shown). The electrical arcs fracture rock in the formation and generate electromagnetic and/or acoustic waves that may be measured by magnetometers 832. Sensor assembly 822 may house magnetometers 832 as shown. Magnetometers 832 may be any suitable type that measures a magnetic field. For example, the magnetometers may be flux gate magnetometers and/or rotating magnetometers that may measure a low-frequency magnetic field such as the magnetic field corresponding to the electromagnetic waves created by the pulsed-power drill bit during a pulsed-power drilling operation. Magnetometers 832 may be individually placed at different positions around the perimeter of sensor assembly 822 or bottom-hole assembly (BHA) 804. For example, magnetometers 816*a*, 816*b*, and 816*c* may be placed at different azimuthal locations to measure the magnetic field in different directions to provide two-dimensional information about the surrounding formation based on the propagation of electromagnetic waves from the pulsed-power drill bit. As another example, magnetometers 832 may be x-y magnetometers that are used to determine the azimuthal direction of electric arcs generated at the pulsed-power drill bit. If magnetometers 832 are placed proximate the distal end of bottom-hole assembly (BHA) 804 near the drill bit, magnetometers 832 may be sampled to obtain the azimuthal direction of each electric arc. Magnetometers 832 may be co-located with one or more accelerometers (not expressly shown) to compensate for the direction of the wellbore relative to a gravitational reference, such as the magnetic north of the Earth's magnetic field.

Figure 9A:
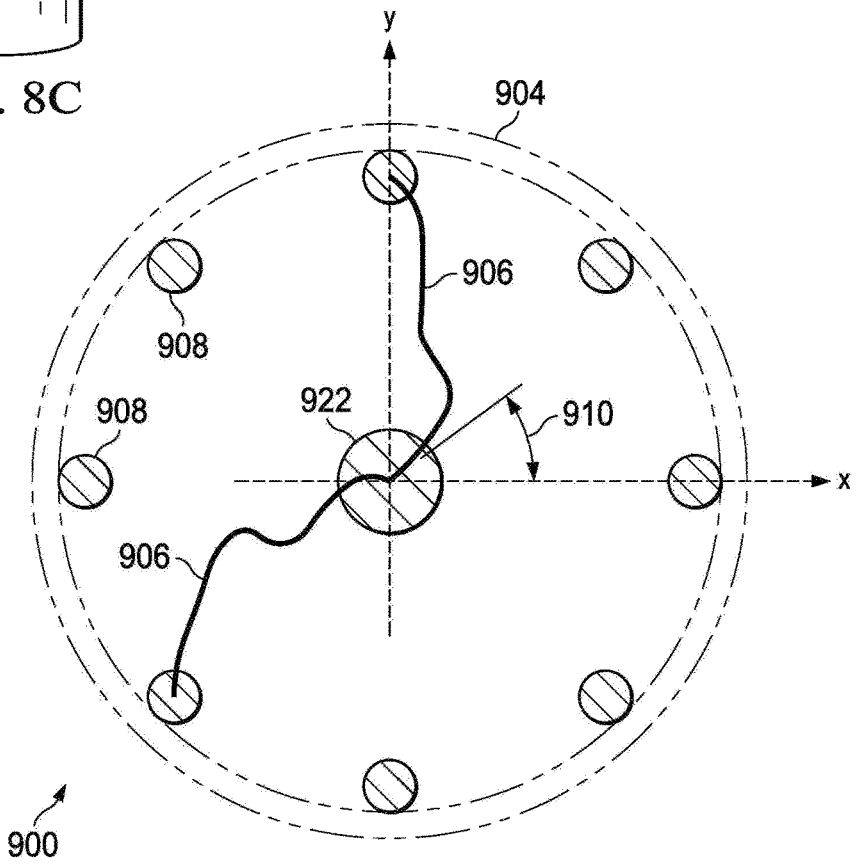
FIG. 9A is a cross sectional view of exemplary components of a bottom-hole assembly of the pulsed-power drilling system that is associated with a sensor analysis system.

FIG. 9A illustrates a bottom up view of exemplary components of a pulsed-power drill bit with an associated sensor analysis system. Drill bit 900 may include one or more center electrodes, such as center electrode 922, and one or more outer electrodes, such as a plurality of electrodes disposed proximate outer wall 904. For example, the electrodes of drill bit 900 may have a configuration as shown in FIGS. 2A and 2B. Electrical arcs 906 may form during pulsed-power drilling operations between center electrode 922 and electrodes proximate outer wall 904.

Electrical arcs 906 may be detected by sensors 908 that are azimuthally distributed along outer wall 904. Responses may be recorded by each of the sensors 908. Sensors 908 may be magnetometers, buttons, current-meters, or any sensor suitable for detecting, measuring, and/or recording responses corresponding to electrical arcs 906. Measurements representing these responses may be used to determine an excitation direction in terms of an azimuth angle, such as azimuthal angle 910. For example, measurements representing raw recorded responses and/or modified measurements may be inputs to an inversion process, as described with respect to FIG. 6.

FIG. 9B is a graph illustrating bins for measurements from multiple sensors azimuthally distributed around a centerline of the bottom-hole assembly (BHA) of the pulsed-power drilling system. Responses from the azimuth sensors, such as sensors 908 in FIG. 9A, may be organized into a series of bins that correspond to the azimuthal location or angle ($\phi_{src}$) of the electrical arcs. For example, each of the azimuth sensors may be placed at different azimuthal locations. Each sensor may provide one or more measurements corresponding to an electrical arc to a sensor analysis system, such as sensor analysis system 422 in FIG. 4 or sensor analysis system 500 in FIG. 5. For example, the sensor analysis system may compare measurements between the sensors to determine the measurement with the highest amplitude. The azimuthal direction for an electrical arc may be determined based on the azimuthal location of the sensor with the highest amplitude measurement. As another example, the azimuthal direction for an electrical arc may be determined based an average azimuthal direction. The sensor analysis system may average the measurements between adjacent sensors and then compare the measurements between the averaged values to determine the measurements with the highest average amplitude. The azimuthal direction for an electrical arc may be determined based on the average azimuthal location between two adjacent sensors with the highest average amplitude measurement. The measurements by the sensors may also be evaluated over many electrical arcs during pulsed-power drilling operations. The sensor analysis system may determine the azimuthal direction for an electrical arc and increment the count of a counter corresponding to the azimuthal direction. Over many electrical arcs, counters corresponding to different azimuthal directions may be incremented.

In the graph shown in FIG. 9B, the horizontal axis represents the azimuthal location ($\phi_{src}$) and the vertical axis represents the number of electrical arcs binned at a particular azimuthal location. Each line in the graph represents a counter corresponding to an azimuthal direction. For example, line 946 represents a counter corresponding to an azimuthal direction of 30 degrees and line 944 represents a counter corresponding to an azimuthal direction of 270 degrees. Although the lines are shown representing counters corresponding to azimuthal directions 60 degrees apart (e.g., 30 degrees, 90 degrees, 150 degrees, etc.), any number of counters may be used.

Although the graph shows bins that correspond to the azimuthal location of the electrical arcs ($\phi_{src}$), the sensor analysis system may make determinations regarding pulsed-power drilling operations based on bins that correspond to the azimuthal location of the received responses ($\phi_{rcv}$) as determined from measurements by one or more sensors located uphole from the drill bit, such as sensors 816*a*, 816*b*, and 816*c* that are shown oriented with different azimuthal directions in FIG. 8B or sensor 816 as shown in FIG. 8A. Though the graph shows measurements organized into a series of bins, measurements from sensors may be organized into a two-dimensional array of bins, in which one dimension corresponds to the azimuthal direction of the electrical arcs ($\phi_{src}$) measured by the azimuth sensors and the other dimension corresponds to the azimuthal direction of the received responses ($\phi_{rcv}$) as determined from measurements by one or more sensors.

As shown in FIG. 9B, the sensor analysis system may organize measurements into a series of bins, in which each bin corresponds to an azimuthal direction and contains a counter representing the number of electric arcs formed in the azimuthal direction of the bin. The sensor analysis system may make determinations regarding a pulsed drilling operation based on the azimuthal direction associated with the counter having the greatest number of counts. Responses recorded by azimuthally distributed sensors may be used in estimating the values of formation parameters around the drill bit. These formation parameters may represent electrical and/or acoustic properties of the formation. For example, electrical parameters that may be estimated based on responses recorded by azimuthally distributed sensors include electrical conductivity $\sigma$, permeability $\varepsilon$, and electrical resistivity, which is inverse of electrical conductivity. Acoustic parameters that may be estimated based on responses recorded by the azimuthally distributed sensors include density d, shear velocity Vs, compressed velocity Vc, and Young's modulus.

The sensor analysis system may also be configured to estimate a parameter of interest along the azimuthal direction at a particular azimuthal angle $\varphi$. Variations in the value of the parameter of interest at different azimuthal angles $\varphi$ may indicate differences in the characteristics of a formation in different directions relative to the drill bit, which may be used to direct or modify a pulsed drilling operation. For example, the sensor analysis system may be configured to determine a more efficient drilling strategy or drilling direction based on differences in the dielectric constant of the formation in different directions relative to the drill bit.

Figure 10:
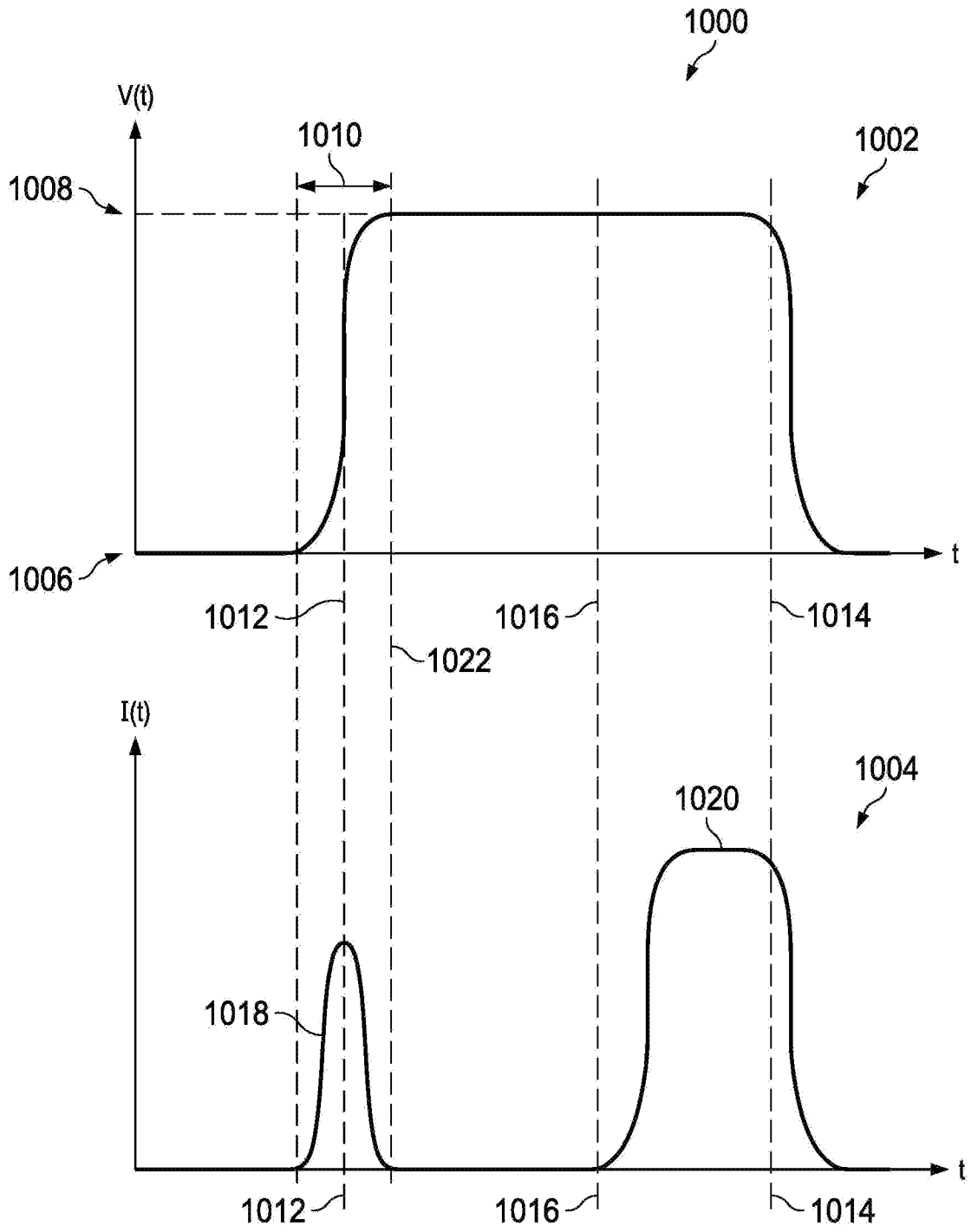
FIG. 10 is a graph illustrating for a high-energy electrical pulse and a current response between electrodes of a pulsed-power drill bit associated with a dielectric mapping system.

FIG. 10 is a graph illustrating a high-energy electrical pulse and current response between electrodes of a pulsed-power drill bit associated with a dielectric mapping system. A pulsed-power drilling system may generate high-energy electrical pulses that cause electrical arcs to form across electrodes on a pulsed-power drill bit. For example, pulse 1002 may represent one of a plurality of high-energy electrical pulses received at the drill bit from a pulse-generating circuit. Chart 1000 shows voltage waveform 1002 in which voltage (V(t)) as a function of time and current waveform 1004 in which current (I(t)) as a function of time. In voltage waveform 1002, voltage is shown on the vertical axis and time is shown on the horizontal axis. The voltage may begin at low voltage 1006 at time zero and rise to high voltage 1008 at time 1022. The period of time to ramp from low voltage 1006 to high voltage 1008 may be the referred to as ramp-up period 1010 ($\tau$). High voltage 1008 may remain from time 1022 until time 1114, at which point the voltage may ramp back down to low voltage 1006. Although high-energy electrical pulse 1002 may be modeled as a square waveform as shown in FIG. 10, the pulse may include a plurality of pulses with a larger ramp-up period, which may reduce the likelihood of dielectric breakdown during the voltage ramp-up period.

Electric charge may form on the electrodes of a pulsed-power drill bit based on electrical pulses received by the pulse-generating circuit. For example, electric charge 750 in FIG. 7 may build up at the end of electrodes 715, 710*a*, and 710*b*. The electrodes may be modeled as a capacitor, such as a parallel-plate capacitor or a cylindrical capacitor. The electrodes of the pulsed-power drill bit may be separated by one or more dielectric materials, such as the formation proximate to the drill bit and/or drilling fluid. The build-up of charge on the electrodes may be modeled by current waveform 1004. In current waveform 1004, current is shown on the vertical axis and time is shown on the horizontal axis. The build-up current 1018 representing the build-up of charge ($I_C$) may be modeled as an impulse that peaks at time 1012, which may correspond to the median of ramp-up period 1010. Build-up current 1018 may be a transient flow of charge that travels through the electrodes to deposit negative charges on one electrode (such as electrode 715) and positive charges on another electrode (such as electrode 710*a* or 710*b*). Current waveform 1004 also illustrates the flow of charge when an electrical arc forms across the electrodes. At an undetermined point in time ($t_d$), such as time 1016, the dielectric material may break down. The break down may typically occur during high-energy electrical pulse. For example, the dielectric may break down at time 1016 when the voltage is at maximum value 1008. The flow of charge corresponding to the electrical arc, which may be referred to as spark current ($I_S$) 1020, may begin at time 1016. Unlike build-up current 1018, spark current 1020 may be proportional to the excitation voltage, such as high voltage 1008. Spark current 1020 may rise to a high value proportional to the excitation voltage and continue to flow at the high value until the high-energy electrical pulse ramps down at time 1014.

The amount of charge ($Q_C$) deposited on one of the electrodes by the flow of build-up current 1018 may be determined by the following equation:

$$Q_C = \int_{t_1-\frac{\tau}{2}}^{t_1+\frac{\tau}{2}} I_C(t)dt \tag{1}$$

In equation (1), $t_1$ is the time at which the current impulse reaches a peak value (at time 1012), $\tau$ is ramp-up period 1010, and $I_C(t)$ is build-up current 1018. The amount of charge ($Q_C$) may be determined by the numerical integration of build-up current 1018 over ramp-up period 1010. For a given high voltage 1008, the amount of charge deposited on one of the electrodes may be proportional to the capacitance of a pair of electrodes. Accordingly, the capacitance of a pair of electrodes is given by the following equation:

$$C_e = \frac{Q_C}{V_{max}} \tag{2}$$

In equation (2), $Q_C$ is the amount of charge on an electrode as, for example, determined by equation (1), and $V_{max}$ is high voltage 1008. The capacitance of a pair of electrodes may also be determined by the following equation:

$$C_e = \frac{I_C(t)}{dV(t)/dt} \tag{3}$$

In equation (3), $I_C(t)$ is build-up current 1018 and dV(t)/dt is the numerical differentiation of V(t), the pulse function. In the frequency domain, the capacitance may be defined to include the broad-band frequency content of the ramp-up voltage by the following Fourier transform:

$$C_e(j\omega) = \frac{I_C(j\omega)}{j\omega V(j\omega)} \tag{4}$$

Using equations (3) or (4), the capacitance may be determined even if the dielectric breakdown occurs before the voltage ramp up to high voltage 1008 has completed. The capacitance may be calculated by a sensor analysis system, such as sensor analysis system 500 in FIG. 5. The value of the dielectric constant of material proximate to the pulsed-power drill bit may be determined based on the capacitance of a pair of electrodes as follows:

$$\varepsilon_{r,eff} = \frac{C_e}{\varepsilon_0} \times \frac{d}{A} \tag{5}$$

In equation (5), $\varepsilon_0$ is the free-space dielectric permittivity, A is the surface area of one of the electrodes, and d is the distance of separation between the pair of electrodes. The dielectric material may include the formation and/or the drilling fluid proximate to the drill bit.

The effective dielectric constant, $\varepsilon_{r,eff}$, may be used in an inversion, such as inversion process 600 described in FIG. 6, as an initial value estimating the dielectric constant. The pulsed-power drill bit may include multiple electrode pairs arranged in different azimuthal directions to provide azimuthal sensitivity for one or more values for the dielectric constant. The inversion may include a model of the drill bit geometry and the dielectric material, such as the formation and/or drilling fluid proximate to the drill bit. If the coupling between different pairs of electrodes is low enough, the inversion may be performed on individual pairs of electrodes to solve for the value of the dielectric constant for each pair of electrodes at a time. Alternatively, the inversion may operate as a joint inversion to solve for one or more values of the dielectric constants for all electrode pairs in parallel. The inversion may start with a received signal and an estimated signal. The received signal may be the amount of charge for the electrode pair ($(Q_C)_n$) or the effective dielectric constant ($\varepsilon_{r,eff}$) of the dielectric material. The estimated signal may be a model response that estimates the charge or the value of the dielectric constant. The inversion may determine the value of the dielectric constant ($\varepsilon_r$) between the electrodes in the electrode pair. If a joint inversion is performed on all electrode pairs, the received signals may be a set of signals for the charge or value for the dielectric constant of a plurality of the electrode pairs and the estimated signals may be a set of signals for the estimated charge or values of the dielectric constants. The joint inversion may determine the azimuthal distribution of the dielectric constant ($(\varepsilon_r)_n$) around the pulsed-power drill bit.

The dielectric distribution ($(\varepsilon_r)_n$) around the pulsed-power drill bit may be presented or used as a two-dimensional log for post processing. The post processing may couple the dielectric distribution with other interpretation methods, such as geomechanical or nuclear magnetic resonance (NMR) methods. For example, the relative amount of water and hydrocarbon in the flushed zone may be determined by the water saturation in the flushed zone ($S_{XO}$), which may be based on the dielectric distribution. As another example, the dielectric distribution may be used to determine the water filled porosity and/or salinity of water using a Complex Refractive Index Model (CRIM) equation and/or a water salinity model. For example, the CRIM equation may provide the relationship between the water filled porosity and the dielectric distribution based on the dielectric constant and the total porosity. The CRIM equation may be used with a Solvation Model based on Density (SMD) to determine the salinity of the water based on the temperature and pressure. In addition to coupling the dielectric distribution with other interpretation methods, post processing may improve drilling performance using the dielectric distribution. For example, the sensor analysis system may determine whether the actual value of the dielectric constant or the dielectric distribution indicates that the value of the dielectric constant for the formation and/or drilling fluid proximate the drill bit is lower than expected by comparing the actual value to an expected value. If the actual value is less than the expected value, an operator of the pulse-power drilling system may select a drilling fluid with a lower value for its dielectric constant than the actual value to improve the performance of pulsed-power drilling operations. The operator may select a drilling fluid based on information from the sensor analysis system. For example, the sensor analysis system may provide an indication that a drilling fluid with a lower value for the dielectric constant should be used for a pulsed drilling operation. As another example, the sensor analysis system may provide a recommendation to the operator specifying the drilling fluid that should be used for a pulsed drilling operation. Although a lower dielectric value or distribution is described for the selected drilling fluid, the pulsed-power drilling performance may also be improved by operating with a drilling fluid having a higher value for its dielectric constant than the actual value.

Relative changes in the value of the dielectric constant may be used if the absolute values of the dielectric constant around the pulsed-power drill bit are not needed for post processing. The average azimuthal direction in which the spark current flows may be determined by using one or more x-y magnetometer sensors, or any of the azimuthal sensors described in FIG. 8A, 8C, or 9A. The sensors may be co-located with one or more accelerometers to accommodate the direction of the wellbore relative to a gravitational reference, such as the magnetic north of the Earth's magnetic field.

When current ($I_S$) flows between a pair of electrodes, the direction of the magnetic field created by the current may be measured by the sensors. By compensating for the earth field effects of the magnetometers, the average direction of the current may be determined by sampling the sensors. The azimuth of the lowest value of the dielectric constant may be monitored in real-time during a pulsed drilling operation if the sampling rate is sufficient to capture individual current flows associated with electrical arcs. Based on the monitored values of the dielectric constant, the direction of pulsed-power drilling operations may be adjusted. For example, a larger value for the dielectric constant in a particular azimuthal direction may indicate that the rock in that direction is more oil bearing than an aqueous rock with a lower value for its dielectric constant. The pulsed-power drilling system may be automated to adjust the direction of drilling based on the value of the dielectric constant in one or more azimuthal directions.

Figure 11:
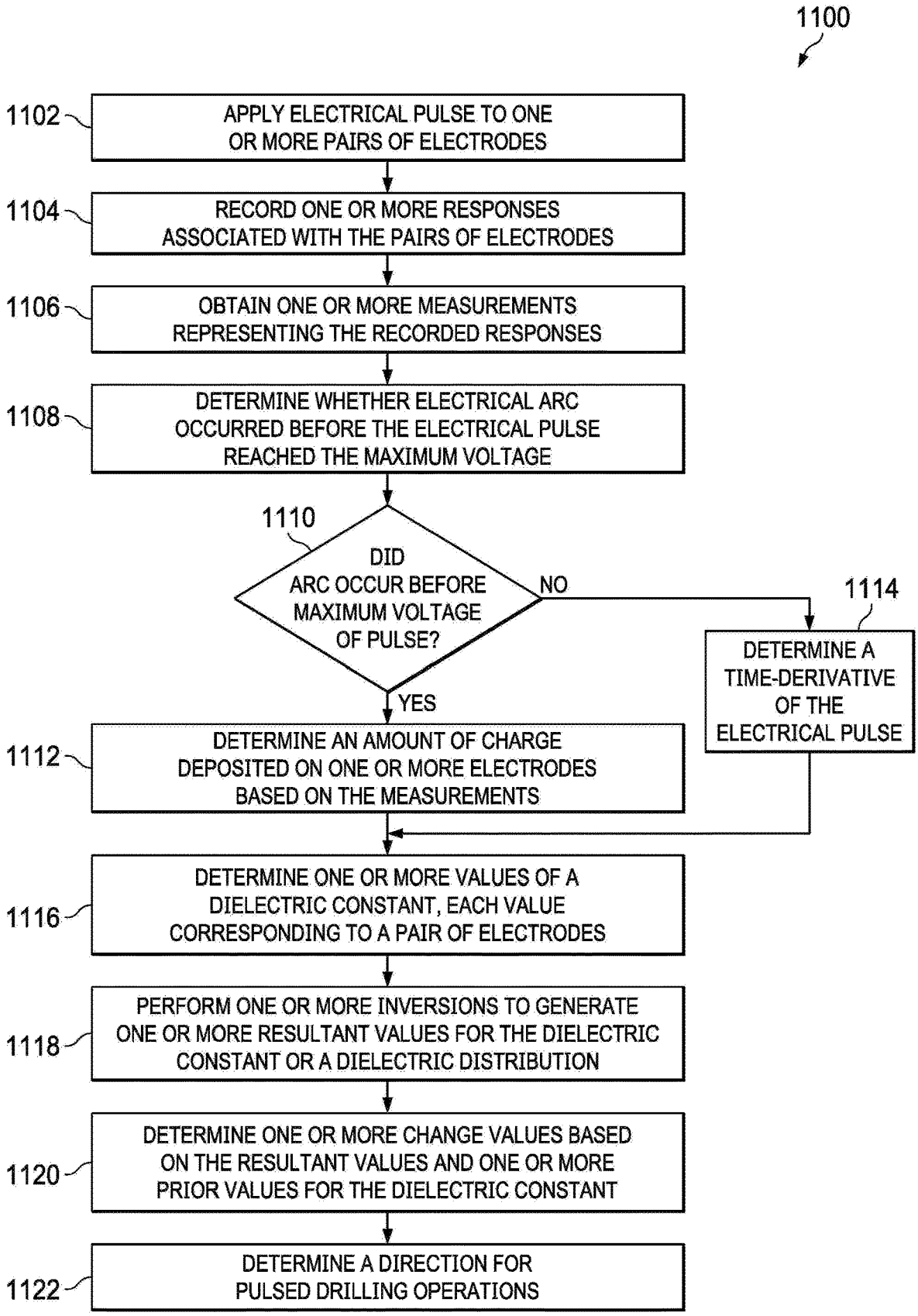
FIG. 11 is a flow diagram illustrating an exemplary method for determining dielectric characteristics using sensor responses capture during pulsed drilling operations.

FIG. 11 is a flow diagram illustrating an exemplary method for determining dielectric characteristics using sensor responses captured during a pulsed drilling operation. Method 1100 may begin and at 1102 an electrical pulse may be applied to one or more pairs of electrodes. A pulse-generating circuit may generate high-energy electrical pulses such that electrical arcs are formed between the pairs of electrodes. The high-energy electrical pulses may cause a build-up current to deposit positive and/or negative charge on one or more electrodes in a pair (such as charges 750 shown in FIG. 7). An electrical arc may form between a pair of electrodes. Although the arc typically forms during the application of the high-energy electrical pulses, the arc may form at any time. The flow of charge corresponding to the electrical arc may be referred to as a spark current. For example, the electrical arc may form between electrode 208 and ground ring 250 in FIG. 2A, which collectively may form a first pair of electrodes, and/or between electrode 212 and ground ring 250 in FIG. 2B, which collectively may form a second pair of electrodes. The electrical arcs are shown by currents 725*a* and 725*b* in FIG. 7.

At 1104, one or more responses associated with the pairs of electrodes may be recorded by one or more sensors. Each response may be associated with a pair of electrodes. The sensor may convert the response into a measurement, which may be a voltage, current, or ratio of voltage to current. For example, an electrical arc may form between a pair of electrodes through a portion of the formation and/or drilling fluid proximate to the drill bit. The sensor may record responses to the build-up current that deposits charge one or more electrodes in a pair. The responses or measurements representing the responses may be measured in the time-domain or frequency-domain as described in FIGS. 4 and 11. For example, if recorded in the frequency-domain, the sensor may measure the amplitude and phase of the build-up current for one or more electrodes. The sensors may include one or more sensors in pulsed-power drill bit 806, one sensor 816 as shown in FIG. 8A, or a plurality of sensors in sensor assembly 822 as shown in FIG. 8B. The sensors may include multimeters, current sensors, or any sensor suitable for measuring the voltage, current, or ratio of voltage to current. The sensors may be powered by power cable 812 in FIG. 8A, a battery, or a charged fiber optic cable as described in FIG. 8A.

At 1106, one or more measurements representing the responses recorded by one or more sensors in 1104 may be obtained by a sensor analysis system. For example, sensor analysis system 422 in FIG. 4 or sensor analysis system 500 in FIG. 5 may obtain or receive the measurements.

At 1108, it may be determined whether an electrical arc occurred before the electrical pulse reached the high voltage. The electrical pulse may begin at a low voltage and ramp-up to a high voltage that may be maintained for a period of time before the voltage ramps back down to the low voltage. For example, FIG. 10 shows low voltage 1006, a ramp-up period 1010 during which the voltage ramps up to high voltage 1008, and a ramp back down to low voltage 1006. The ramp-up period 1010 is completed at time 1022. The sensor analysis system may compare the time of the electrical pulse to the time at which the electrical arc reaches a high voltage. For example, FIG. 10 shows the time of the electrical arc at time 1016, and the time at which the electrical arc reaches high voltage 1008 at time 1022. The sensor analysis system may measure the current during the period between time 1012 and time 1014 in FIG. 10 and examine the waveform of the measured current may to determine whether two distinct peaks occurred before time 1022. The two distinct peaks may correspond to build-up current 1018 and spark current 1022 in FIG. 10. As another example, the sensor analysis system may measure the input impedance at the drill bit to determine whether an electric arc occurred based on a low input impedance. The time of the low input impedance may be compared to the time at which the electrical pulse reached the high voltage.

At 1110, if the arc occurred before the high-energy electrical pulse ramp-up to the high voltage has completed, method 1100 may proceed to 1112. Otherwise, method 1100 may proceed to 1114.

At 1112, an amount of charge deposited on one or more electrodes on the drill bit may be determined based on the one or more measurements obtained in 1106. During the application of the high-energy electrical pulse, charge may accumulate on one or more electrodes in a pair, such as the positive and negative charges 750 shown in FIG. 7. A sensor may record responses corresponding to the build-up current associated with the build-up period of the high-energy electrical pulse. As described by equation (1), for example, the amount of charge is determined by performing a numerical integration of the build-up current over the high-energy electrical pulse ramp-up period. The amount of charge may be used to determine the capacitance at an electrode on pulsed-power drill bit, which in turn may be used to determine the value of the dielectric constant for the formation and/or drilling fluid proximate to the pulsed-power drill bit. The amount of charge may represent the charge on one electrode in a pair of electrodes. Although the amount of charge is described for one electrode, the amount of charge may be determined for any electrode including, but not limited to the amount of charge on an electrode in another pair of electrodes on the pulsed-power drill bit.

At 1114, a time-derivative of the high-energy electrical pulse may be determined as described in equations (3) or (4). The determination may be performed within a sensor or the sensor analysis system. If V(t) is the high-energy electrical pulse function in the time-domain, the time-derivative may be taken to determine the capacitance at the electrodes of the pulsed-power drill bit. If a Fourier transform is applied to the recorded response or measurement, $j\omega V(j\omega)$ represents the equivalent of $dV(t)/dt$ in the frequency-domain. Equations (3) or (4) may be used even if the dielectric breakdown associated with the electrical arc occurs before the high-energy electrical pulse ramp-up to the high voltage has completed. The time-derivative may then be used to determine the capacitance at the pulsed-power drill bit.

At 1116, one or more values for the dielectric constant may be determined based on the measurements. The determination may be performed by one or more sensors and/or the sensor analysis system. The value of the dielectric constant may be based on the capacitance of an electrode on the drill bit as described in equation (5). The capacitance may be calculated using the amount of charge on an electrode in a pair of electrodes as determined in 1112 or the time-derivative as determined in 1114. The capacitance may also be calculated using the free-space dielectric permittivity value, the surface area of one of the electrodes, and/or the distance of separation between the first pair of electrodes. The values for the dielectric constant may be an effective dielectric constant.

At 1118, one or more inversions may be performed by a sensor analysis system, such as sensor analysis system 422 in FIG. 4 or sensor analysis system 500 in FIG. 5. The inversion (such as inversion process 600 in FIG. 6) may be based on the determined value of the dielectric constant and a known value of the dielectric constant associated with the formation and/or drilling fluid. For example, the determined value may be input as received signals 604 and the known value may be input as estimated signals 606 in FIG. 6. The inversion may generate one or more resultant values for the dielectric constant, in which each value may represent the actual value of the dielectric constant associated with the formation and/or drilling fluid. Although an inversion of the one pair of electrodes is described, the inversion may be performed on any number of individual pairs of electrodes on the pulsed-power drill bit. The inversion may be performed on each pair of electrodes individually if the coupling between electrode pairs is sufficiently low. Alternatively, a joint inversion may be performed using values for the dielectric constant. A first value may represent the dielectric constant between a first pair of electrodes and the second value may represent the dielectric constant between a second pair of electrodes. The joint inversion using the first and second values as inputs (such as received signals 604 in FIG. 6) may generate a dielectric distribution around the drill bit as described in FIG. 10.

At 1120, one or more change values of a dielectric constant may be determined based on the resultant value and a prior value of the dielectric constant. The determination may be performed by a sensor (such as sensor 816 in FIGS. 9A-C) or a sensor analysis system (such as sensor analysis system 500 in FIG. 5). For example, the resultant value of the dielectric constant may represent the dielectric constant between a pair of electrodes as determined in 1118 and the prior value may be the value of the dielectric constant between the same pair of electrodes at an earlier point in time during the pulsed drilling operation. The prior value of the dielectric constant may be based on prior measurements obtained by a sensor analysis system from one or more sensors that recorded prior responses associated with the pair of electrodes. For example, the sensors may be recorded build-up currents associated prior high-energy electrical pulses. A dielectric change value may be used to determine a direction for a pulsed drilling operation in 1122 if the resultant values of the dielectric constant proximate to the drill bit are not needed for post processing.

At 1122, a direction for a pulsed drilling operation may be determined. For example, the drill bit may be oriented in a particular direction. The determination may be performed by a sensor or the sensor analysis system (such as sensor analysis system 500 in FIG. 5). The direction may be based on one or more values of the dielectric constant as determined in 1116, one or more resultant values of the dielectric constant or a dielectric distribution as determined in 1118, or one or more change values of the dielectric constant as determined in 1120. Post processing, which may be performed in the sensor analysis system, may couple one or more values of the dielectric constant with other interpretation methods, such as geomechanical or NMR methods. The post processing may determine the direction based on a number of considerations. For example, the direction may be based on the relative amount of water and hydrocarbon in the flushed zone. As another example, the direction may be based on the water filled porosity and/or salinity of water. The direction determined in 1122 may be used to orient the pulsed-power drill bit to improve pulsed-power drilling performance by adjusting the drilling fluid used to align with one or more values determined in 1116 through 1120. Subsequently, method 1100 may end.

Modifications, additions, or omissions may be made to method 1100 without departing from the scope of the disclosure. For example, the order of the steps may be performed in a different manner than that described and some steps may be performed at the same time. Additionally, each individual step may include additional steps without departing from the scope of the present disclosure. For example, the capacitance may be calculated based on the amount of charge (1112) or the time-derivative of the high-energy electrical pulse (1114). One of the two approaches may be used without the need for the alternative approach. Method 1100 may also repeat. For example, each electrical pulse or electrical arc may follow method 1100. Method 1100 may be performed for a plurality of electrical pulses or electrical arcs.

Figure 12:
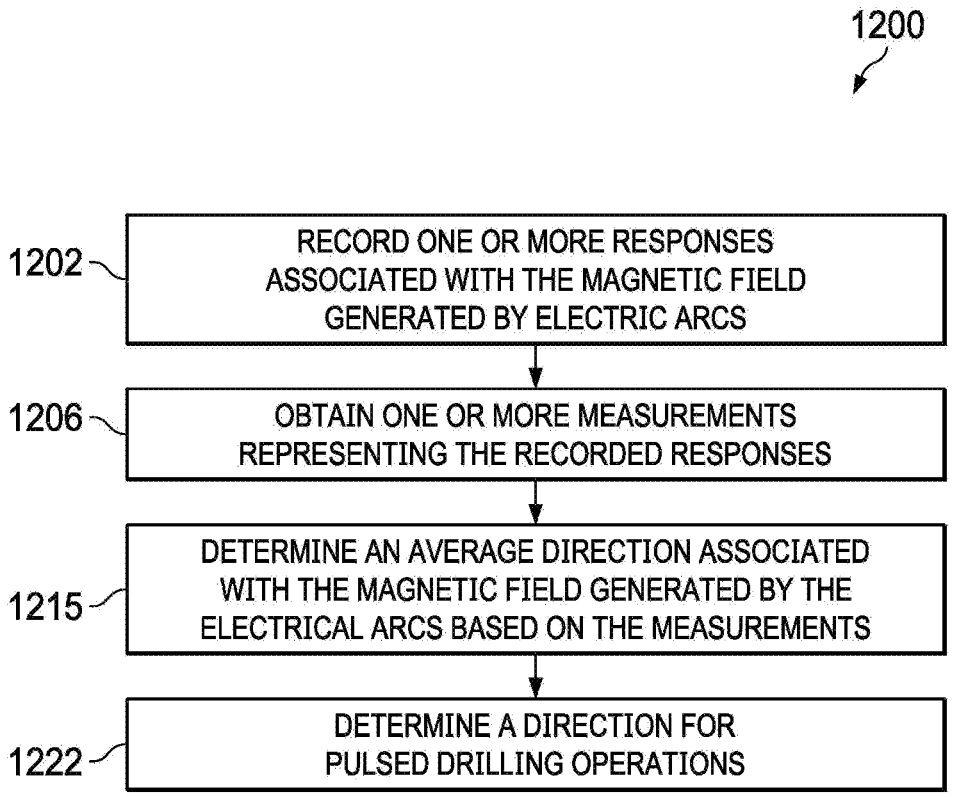
FIG. 12 is a flow diagram illustrating an exemplary method for determining an average direction of electrical arcs using sensor responses captured during a pulsed drilling operation.

FIG. 12 is a flow diagram illustrating an exemplary method for determining an average direction of electrical arcs using sensor responses captured during a pulsed drilling operation. Method 1200 may begin and at 1202, one or more sensors may record one or more responses associated with a magnetic field generated by an electrical arc during a pulsed drilling operation. For example, an x-y magnetometer may record a response of the magnetic field, such as the magnitude and azimuthal direction of the field.

At 1206, one or more measurements representing the responses recorded in 1202 may be obtained by a sensor analysis system. For example, sensor analysis system 500 in FIG. 5 may obtain or receive the measurements. The sensor or sensor analysis system (such as system 500 in FIG. 5) may convert the raw responses into a measurement. For example, the measurement may be a digital representation of the response. As another example, the measurement may be a time-averaged value of a plurality of responses.

At 1215, an average direction associated with the magnetic field generated by the electrical arcs may be determined based on the measurements. The azimuthal direction may be monitored in real-time during a pulsed drilling operation if the rate at which the magnetometer or the sensor analysis system records responses is sufficient to capture the flow of charge associated with individual electrical arcs. The azimuthal direction may indicate the direction in which the value of the dielectric constant is the lowest, because the electrical arcs typically form between electrodes having the lowest dielectric constant.

In addition, the measurement of the x-y magnetometer may be used to determine the average direction of current associated with the electrical arcs. For example, magnetometers 832 in FIG. 8C may be x-y magnetometers. The x-y magnetometers, or the sensor analysis system to which they may be communicatively coupled, may be co-located with one or more accelerometers to accommodate the direction of the wellbore relative to a gravitational reference. Measurements by the x-y magnetometers may be compensated to account for earth field effects.

At 1222, a direction for a pulsed drilling operation may be determined. For example, the drill bit may be oriented in a particular direction. The determination may be performed by a sensor or the sensor analysis system (such as sensor analysis system 500 in FIG. 5). The direction may be based on one or more values described in 1122 in FIG. 11 and the average direction of the electrical arcs. Post processing may be performed as described in FIG. 11. Subsequently, method 1200 may end.

Modifications, additions, or omissions may be made to method 1200 without departing from the scope of the disclosure. For example, the order of the steps may be performed in a different manner than that described and some steps may be performed at the same time. Additionally, each individual step may include additional steps without departing from the scope of the present disclosure.

Embodiments herein may include:

A. A downhole drilling system including a pulse-generating circuit, a drill bit including a first pair of electrodes electrically coupled to the pulse-generating circuit to receive a first electrical pulse from the pulse-generating circuit and form a first electrical arc between the first pair of electrodes during a pulsed drilling operation; a sensor to record responses to the first electrical pulse during the pulsed drilling operation; and a sensor analysis system communicatively coupled to the sensor, the sensor analysis system configured to obtain a first measurement from the sensor, the first measurement representing the responses recorded by the sensor during the pulsed drilling operation and determine a first value of the dielectric constant associated with a portion of a formation in proximity to the drill bit, the first value based on the first measurement.

B. A method including forming, by a drill bit, a first electrical arc between a first pair of electrodes by applying a first electrical pulse to the first pair of electrodes during a pulsed drilling operation; recording responses to the first electrical pulse during the pulsed drilling operation; obtaining a first measurement representing the recorded responses; and determining a first value of the dielectric constant associated with a portion of a formation in proximity to the drill bit, the first value based on the first measurement.

C. A sensor analysis system including a computer processor and a computer-readable medium for storing instructions, the instructions when read and executed by the computer processor cause the processor to: receive a first measurement from a sensor, the first measurement representing responses recorded by the sensor, the responses to first electrical pulse applied to a first pair of electrodes on a drill bit during pulsed drilling operation; and determine a first value of the dielectric constant associated with a portion of a formation in proximity to the drill bit, the first value based on the first measurement.

Each of embodiments A, B, and C may have one or more of the following additional elements in any combination: Element 1: wherein the sensor analysis system is further configured to determine an amount of charge deposited on the first pair of electrodes based on the first measurement, the first value of the dielectric constant further based on the amount of charge deposited on at least one electrode in the first pair of electrodes; Element 2: wherein the sensor analysis system is further configured to determine a time-derivative associated with the first electrical pulse, the first value of the dielectric constant further based on the time-derivative; Element 3: wherein the first value of the dielectric constant is further based on a distance between the first pair of electrodes; Element 4: wherein the sensor analysis system is further configured to perform an inversion on the first value of the dielectric constant to generate a resultant value of the dielectric constant based on a known value of the dielectric constant for the formation; Element 5: wherein the sensor analysis system is further configured to determine a change value of the dielectric constant based on the first value of the dielectric constant and a second value of the dielectric constant, the second value based on a prior measurement associated with an electrical pulse that occurred before the first electrical pulse and determine a direction for the drill bit during the pulsed drilling operation based on the change value; Element 6: further comprising a second sensor to record responses to a second electrical pulse during the pulsed drilling operation, wherein the first pair of electrodes is associated with a first azimuthal location, the drill bit further includes a second pair of electrodes electrically coupled to the pulse-generating circuit to receive the second electrical pulse from the pulse-generating circuit and form a second electrical arc between the second pair of electrodes during the pulsed drilling operation, the second pair of electrodes is associated with a second azimuthal location, and the sensor analysis system is further configured to obtain a second measurement from the second sensor, the second measurement representing the responses recorded by the second sensor during the pulsed drilling operation, determine a second value of the dielectric constant associated with the portion of the formation in proximity to the drill bit, the second value based on the second measurement, and perform an inversion on the first value of the dielectric constant and second value of the dielectric constant to generate a dielectric distribution around the drill bit; Element 7: wherein the sensor analysis system is further configured to obtain a measurement associated with a magnetic field from a magnetometer, the measurement representing a response to the magnetic field, the magnetic field generated by the first electrical arc formed between the first pair of electrodes during the pulsed drilling operation, and determine an average direction associated with the first electrical arc based on the measurement representing the response to the magnetic field; Element 8: wherein the first measurement includes an amplitude and phase of a current associated with the first electrical pulse; Element 9: wherein the first measurement is selected from a group consisting of currents, voltages, ratios of voltage and current and combinations thereof; and Element 10: wherein the sensor analysis system is further configured to determine whether the first value of the dielectric constant is less than a known value of the dielectric constant, and provide an indication to use a drilling fluid for the pulsed drilling operation based on a determination that the first value is less than the known value, a dielectric constant of the drilling fluid is less than the first value of the dielectric constant.

Although the present disclosure has been described with several embodiments, various changes and modifications may be suggested to one skilled in the art. It is intended that the present disclosure encompasses such various changes and modifications as falling within the scope of the appended claims.

What is claimed is:

1. A downhole drilling system, comprising:

a pulse-generating circuit;

a drill bit including a first pair of electrodes electrically coupled to the pulse-generating circuit to receive a first electrical pulse from the pulse-generating circuit and form a first electrical arc between the first pair of electrodes during a pulsed drilling operation;

a sensor to record responses to the first electrical pulse during the pulsed drilling operation; and a sensor analysis system communicatively coupled to the sensor, the sensor analysis system configured to:

generate an estimate of a dielectric constant;

obtain a first measurement from the sensor, the first measurement representing the responses recorded by the sensor during the pulsed drilling operation;

determine a measured value of a dielectric constant based on the first measurement;

determine that the estimate of the dielectric constant and the measured value of the dielectric constant converge; and output a first value of a dielectric constant associated with a portion of a formation in proximity to the drill bit based, at least in part, on the convergence.

2. The downhole drilling system of claim 1, wherein the sensor analysis system is further configured to determine an amount of charge deposited on the first pair of electrodes based on the first measurement, wherein:

the first measurement is selected from a group consisting of a current, a voltage, a ratio of voltage and current and combinations thereof; and the first value of the dielectric constant further based on the amount of charge deposited on at least one electrode in the first pair of electrodes or a distance between the first pair of electrodes.

3. The downhole drilling system of claim 1, wherein the sensor analysis system is further configured to determine a time-derivative associated with the first electrical pulse, the first value of the dielectric constant further based on the time-derivative.

4. The downhole drilling system of claim 1, wherein the sensor analysis system is further configured to:

perform an inversion on the first value of the dielectric constant to generate a resultant value of the dielectric constant based on a known value of the dielectric constant for the formation;

determine a change value of the dielectric constant based on the resultant value of the dielectric constant and a second value of the dielectric constant, the second value based on a prior measurement associated with an electrical pulse that occurred before the first electrical pulse; and determine a direction for the drill bit during the pulsed drilling operation based on the change value.

5. The downhole drilling system of claim 1, further comprising:

a second sensor to record responses to a second electrical pulse during the pulsed drilling operation, wherein:

the first pair of electrodes is associated with a first azimuthal location;

the drill bit further includes a second pair of electrodes electrically coupled to the pulse-generating circuit to receive the second electrical pulse from the pulse-generating circuit and form a second electrical arc between the second pair of electrodes during the pulsed drilling operation, the second pair of electrodes associated with a second azimuthal location; and the sensor analysis system is communicatively coupled to the second sensor, the sensor analysis system configured to:

obtain a second measurement from the second sensor, the second measurement representing the responses recorded by the second sensor during the pulsed drilling operation;

determine a second value of the dielectric constant associated with another portion of the formation in proximity to the drill bit, the second value based on the second measurement; and perform a joint inversion on the first value of the dielectric constant and second value of the dielectric constant to generate a dielectric distribution around the drill bit.

6. The downhole drilling system of claim 1, wherein the sensor analysis system is further configured to:

obtain a measurement associated with a magnetic field from a magnetometer, the measurement representing a response to the magnetic field, the magnetic field generated by the first electrical arc formed between the first pair of electrodes during the pulsed drilling operation; and determine an average direction associated with the first electrical arc based on the measurement representing the response to the magnetic field.

7. The downhole drilling system of claim 1, wherein the sensor analysis system is further configured to:

determine whether the first value of the dielectric constant is less than a known value of the dielectric constant; and provide an indication to use a drilling fluid for the pulsed drilling operation based on the determination that the first value is less than the known value, wherein the dielectric constant of the drilling fluid is less than the first value of the dielectric constant.

8. A method, comprising:

forming, by a drill bit, a first electrical arc between a first pair of electrodes by applying a first electrical pulse to the first pair of electrodes during a pulsed drilling operation;

recording responses to the first electrical pulse during the pulsed drilling operation;

generating an estimate of a dielectric constant;

obtaining a first measurement representing the recorded responses;

determining a measured value of a dielectric constant based on the first measurement;

determining that the estimate of the dielectric constant and the measured value of the dielectric constant converge; and determining a first value of a dielectric constant associated with a portion of a formation in proximity to the drill bit based, at least in part, on the convergence.

9. The method of claim 8, further comprising:

determining an amount of charge deposited on the first pair of electrodes based on the first measurement, wherein:

the first measurement is selected from a group consisting of currents, voltages, ratios of voltage and current and combinations thereof; and the first value of the dielectric constant further based on the amount of charge deposited on at least one electrode in the first pair of electrodes or a distance between the first pair of electrodes.

10. The method of claim 8, further comprising determining a time-derivative associated with the first electrical pulse, the first value of the dielectric constant further based on the time-derivative.

11. The method of claim 8, further comprising:

performing an inversion on the first value of the dielectric constant;

generating a resultant value of the dielectric constant based on a known value of the dielectric constant for the formation;

determining a change value of the dielectric constant based on the resultant value of the dielectric constant and a second value of the dielectric constant, the second value based on a prior measurement associated with an electrical pulse that occurred before the first electrical pulse; and determining a direction for the drill bit during the pulsed drilling operation based on the change value.

12. The method of claim 8, further comprising:

forming, by the drill bit, a second electrical arc between a second pair of electrodes by applying a second electrical pulse to the second pair of electrodes during the pulsed drilling operation;

recording responses to the second electrical pulse during the pulsed drilling operation;

obtaining a second measurement representing the recorded responses to the second electrical pulse;

determining a second value of the dielectric constant associated with the portion of the formation in proximity to the drill bit, the second value based on the second measurement; and performing an inversion on the first value of the dielectric constant and the second value of the dielectric constant to generate a dielectric distribution around the drill bit.

13. The method of claim 8, further comprising:

recording responses to a magnetic field, the magnetic field generated by the first electrical arc formed between the first pair of electrodes during the pulsed drilling operation;

obtaining a measurement representing the recorded responses to the magnetic field; and determining an average direction associated with the first electrical arc based on the measurement representing the recorded responses to the magnetic field.

14. The method of claim 8, further comprising:

determining whether the first value of the dielectric constant is less than a known value of the dielectric constant; and providing an indication to use a drilling fluid for the pulsed drilling operation based on the determination that the first value is less than the known value, the drilling fluid having a dielectric constant that is less than the first value.

15. A sensor analysis system, comprising:

a computer processor;

a computer-readable medium for storing instructions, the instructions when read and executed by the computer processor cause the processor to:

generate an estimate of a dielectric constant;

receive a first measurement from a first sensor, the first measurement representing responses recorded by the first sensor, the responses recorded by the first sensor in response to a first electrical pulse applied to a first pair of electrodes on a drill bit during pulsed drilling operation;

determine that the estimate of the dielectric constant and a measured value of a dielectric constant converge, wherein the measured value of the dielectric constant is based on the first measurement; and determine a first value of a dielectric constant associated with a portion of a formation in proximity to the drill bit, wherein the first value of the dielectric constant is based, at least in part, on the convergence.

16. The sensor analysis system of claim 15, the instructions when read and executed by the computer processor further cause the processor to:

determine an amount of charge deposited on the first pair of electrodes based on the first measurement, wherein:

the first measurement is selected from a group consisting of currents, voltages, ratios of voltage and current and combinations thereof; and the first value of the dielectric constant further based on the amount of charge deposited on at least one electrode in the first pair of electrodes or a distance between the first pair of electrodes.

17. The sensor analysis system of claim 15, the instructions when read and executed by the computer processor further cause the processor to:

determine a time-derivative associated with the first electrical pulse, the first value of the dielectric constant further based on the time-derivative.

18. The sensor analysis system of claim 15, the instructions when read and executed by the computer processor further cause the processor to:

perform an inversion on the first value of the dielectric constant;

generate a resultant value of the dielectric constant based on a known value of the dielectric constant for the formation;

determine a change value of the dielectric constant based on the resultant value of the dielectric constant and a second value of the dielectric constant, the second value based on a prior measurement associated with an electrical pulse that occurred before the first electrical pulse; and determine a direction for the drill bit during the pulsed drilling operation based on the change value.

19. The sensor analysis system of claim 15, the instructions when read and executed by the computer processor further cause the processor to:

receive a second measurement from a second sensor, the second measurement representing responses recorded by the second sensor, the responses recorded by the second sensor in response to a second electrical pulse applied to a second pair of electrodes on the drill bit during the pulsed drilling operation;

determine a second value of the dielectric constant associated with the portion of the formation in proximity to the drill bit, the second value based on the second measurement; and performing an inversion on the first value of the dielectric constant and second value of the dielectric constant to generate a dielectric distribution around the drill bit.

20. The sensor analysis system of claim 15, the instructions when read and executed by the computer processor further cause the processor to:

receive a measurement from a magnetometer, the measurement representing responses recorded by the magnetometer, the responses recorded by the magnetometer in response to a magnetic field, the magnetic field generated by an electrical arc formed between the first pair of electrodes during the pulsed drilling operation; and determine an average direction associated with the first value of the dielectric constant based on the measurement associated with the magnetic field.

21. The sensor analysis system of claim 15, wherein the first measurement includes an amplitude and a phase of a current associated with the first electrical pulse.

22. The sensor analysis system of claim 15, the instructions when read and executed by the computer processor further cause the processor to:

determine whether the first value of the dielectric constant is less than a known value of the dielectric constant; and provide an indication to use a drilling fluid for the pulsed drilling operation based on the determination that the first value is less than the known value, the drilling fluid having a dielectric constant that is less than the first value.

* * * * *